US009887061B2

(12) United States Patent
Kobayashi et al.

(10) Patent No.: US 9,887,061 B2
(45) Date of Patent: Feb. 6, 2018

(54) X-RAY TUBE DEVICE AND METHOD FOR USING X-RAY TUBE DEVICE

(75) Inventors: Takumi Kobayashi, Kizugawa (JP); Masaaki Ukita, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 7 days.

(21) Appl. No.: 14/427,580

(22) PCT Filed: Sep. 12, 2012

(86) PCT No.: PCT/JP2012/073340

§ 371 (c)(1),
(2), (4) Date: May 11, 2015

(87) PCT Pub. No.: WO2014/041639

PCT Pub. Date: Mar. 20, 2014

(65) Prior Publication Data

US 2015/0262782 A1 Sep. 17, 2015

(51) Int. Cl.

| | |
|---|---|
| ***H01J 35/06*** | (2006.01) |
| ***H01J 1/16*** | (2006.01) |
| ***H01J 35/16*** | (2006.01) |
| *H01J 35/30* | (2006.01) |

(52) U.S. Cl.

CPC ..... *H01J 35/06* (2013.01); *H01J 1/16* (2013.01); *H01J 35/16* (2013.01); *H01J 35/305* (2013.01)

(58) Field of Classification Search

CPC ..... H01J 35/06; H01J 9/04; H01J 1/18; H01J 2201/2803; H01J 1/15; H01J 1/16; H01J 2235/06

See application file for complete search history.

(56) References Cited

U.S. PATENT DOCUMENTS 3,082,339 A * 3/1963 Manfredi ..... H01J 21/36 313/250
5,343,112 A * 8/1994 Wegmann ..... H01J 1/16 313/341
5,828,727 A * 10/1998 Schild ..... H01J 35/18 378/121

(Continued)

FOREIGN PATENT DOCUMENTS

CN 101779265 B 1/2013
JP 57-013658 A 1/1982

(Continued)

OTHER PUBLICATIONS

International Search Report PCT/JP2012/073340 dated Nov. 20, 2012 with English Translation.

(Continued)

*Primary Examiner* — Wyatt Stoffa
(74) *Attorney, Agent, or Firm* — McDermott Will & Emery LLP

(57) ABSTRACT

This X-ray tube device includes an anode and a cathode including an emitter emitting an electron to the anode. The emitter includes an electron emission portion in a flat plate shape, a pair of terminal portions extending from the electron emission portion, connected to an electrode, and a supporting portion provided separately from the terminal portions, insulated from the electrode, supporting the electron emission portion.

11 Claims, 12 Drawing Sheets

(56) References Cited

U.S. PATENT DOCUMENTS 6,115,453 A * 9/2000 Hell ..... H01J 1/16 378/113
6,259,193 B1 * 7/2001 Lipkin ..... H01J 1/18 313/271
6,426,587 B1 * 7/2002 Hell ..... H01J 1/16 313/341
6,464,551 B1 * 10/2002 Lipkin ..... H01J 1/18 445/50
6,624,555 B2 * 9/2003 Hell ..... H01J 1/16 313/310
6,646,366 B2 * 11/2003 Hell ..... H01J 1/16 313/310
7,693,265 B2 * 4/2010 Hauttmann ..... H01J 35/06 378/136
7,982,382 B2 * 7/2011 Liu ..... H01J 1/14 313/310
8,000,449 B2 * 8/2011 Hauttmann ..... H01J 35/06 313/310
8,175,222 B2 * 5/2012 Moore ..... H01J 35/06 378/129
8,247,971 B1 * 8/2012 Bard ..... H01J 1/16 313/310
8,254,526 B2 8/2012 Hauttmann
9,202,663 B2 * 12/2015 Yoshizawa ..... H01J 35/06
9,530,603 B1 * 12/2016 Kobayashi ..... H01J 1/16
2001/0052743 A1 * 12/2001 Hell ..... H01J 1/16 313/341
2002/0126798 A1 * 9/2002 Harris ..... H01J 35/06 378/136
2002/0167258 A1 11/2002 Dittrich et al.
2003/0025429 A1 * 2/2003 Hell ..... H01J 1/16 313/310
2004/0222199 A1 * 11/2004 Haga ..... H01L 21/67103 219/121.12
2005/0130549 A1 6/2005 Lemarchand et al.
2007/0183577 A1 * 8/2007 Arnold ..... H01J 35/06 378/136
2007/0246789 A1 * 10/2007 Freudenberger ..... H01J 1/16 257/448
2010/0176708 A1 * 7/2010 Hauttmann ..... H01J 1/15 313/310
2010/0195797 A1 * 8/2010 Hauttmann ..... H01J 35/06 378/136
2010/0195799 A1 * 8/2010 Tomita ..... H01J 35/14 378/138
2010/0207508 A1 8/2010 Terletska et al.
2010/0316192 A1 * 12/2010 Hauttmann ..... H01J 35/06 378/136
2011/0051898 A1 * 3/2011 Moore ..... H01J 35/06 378/121
2014/0079187 A1 * 3/2014 Zhang ..... H01J 35/06 378/136
2017/0092456 A1 * 3/2017 Zhang ..... H01J 35/06

FOREIGN PATENT DOCUMENTS

JP 61-260529 A 11/1986
JP 10-321119 A 12/1998
JP 2000-093419 A 4/2000
JP 2002-298771 A 10/2002
JP 2005-174939 A 6/2005
JP 2009-536777 A 10/2009
JP 2010-534395 A 11/2010
JP 2010-534396 A 11/2010
JP 2010-277822 A 12/2010

OTHER PUBLICATIONS

Peter Schardt et al., "New x-ray tube performance in computer tomorgraphy by introducing the rotating envelope tube technology", Med. Phys. 31 (9) Sep. 2004, pp. 2699-2706.
Written Opinion of the International Searching Authority PCT/JP2012/073340 dated Nov. 20, 2012.

* cited by examiner (FIRST EMBODIMENT)

(FIRST EMBODIMENT)

(FIRST EMBODIMENT)

(FIRST EMBODIMENT)

(FIRST EMBODIMENT)

FIG.6 (COMPARATIVE EXAMPLE)
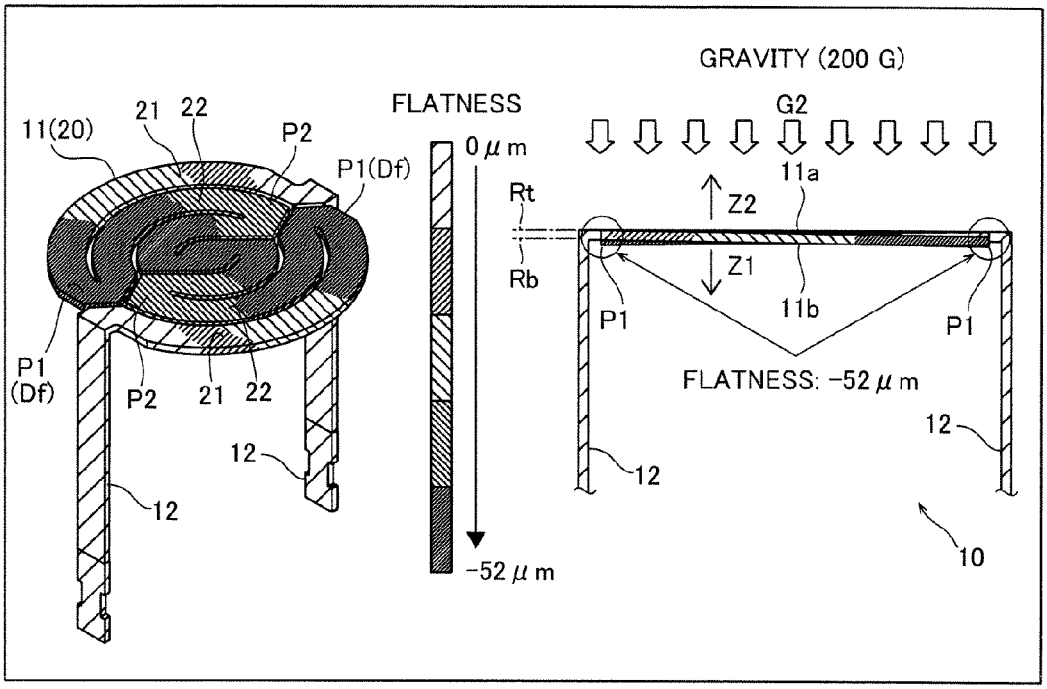
FIG.7 (EXAMPLE)
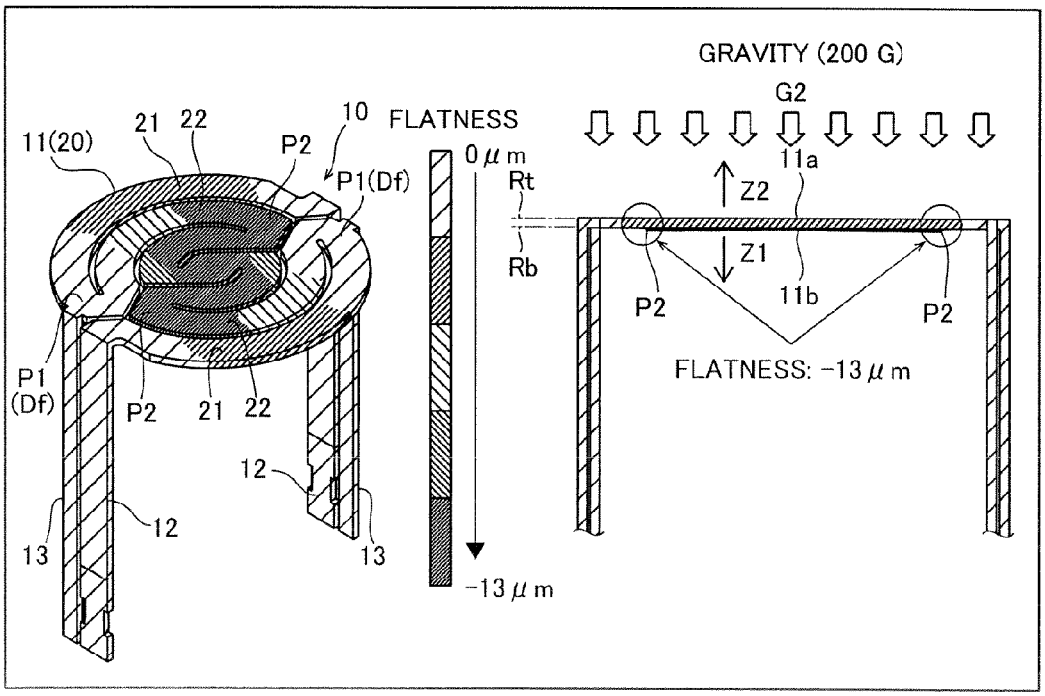

(SECOND EMBODIMENT)

(SECOND EMBODIMENT)

(THIRD EMBODIMENT)

(THIRD EMBODIMENT)

(FOURTH EMBODIMENT)

(FOURTH EMBODIMENT)

(FIFTH EMBODIMENT)

(FIFTH EMBODIMENT)

(SIXTH EMBODIMENT)

(SEVENTH EMBODIMENT)

X-RAY TUBE DEVICE AND METHOD FOR USING X-RAY TUBE DEVICE

CROSS-REFERENCE TO RELATED APPLICATIONS

This application is the U.S. National Phase of PCT/JP2012/073340 filed Sep. 12, 2012. The subject matter of each is incorporated herein by reference in entirety.

TECHNICAL FIELD

The present invention relates to an X-ray tube device and a method for using an X-ray tube device, and more particularly, it relates to an X-ray tube device and a method for using an X-ray tube device each including an emitter having a flat plate-like electron emission portion.

BACKGROUND ART

In general, an X-ray tube device including an emitter having a flat plate-like electron emission portion is known. Such an X-ray tube device is disclosed in National Patent Publication Gazette No. 2010-534396, for example.

An X-ray tube device disclosed in the aforementioned National Patent Publication Gazette No. 2010-534396 includes an emitter including a flat plate-like electron emission portion and a pair of (two) terminal portions connecting the electron emission portion and an electrode to each other. An anisotropic polycrystalline material (tungsten) having a long crystal structure is employed for the electron emission portion. The terminal portions support the lower surface (a surface opposite to an electron emission surface) of the flat plate-like electron emission portion in the vicinity of both ends and have a function of applying an electric current to the electron emission portion. The electron emission portion is applied with an electric current through the terminal portions to be heated to at least about 2000° C., whereby the electron emission portion emits an electron. Therefore, the electron emission portion is creep-deformed by a high temperature associated with the use of the emitter and external force acting on the electron emission portion. In the aforementioned National Patent Publication Gazette No. 2010-534396, the electron emission portion is configured such that the longitudinal direction of crystal grains is oriented in a prescribed direction, and the mechanical strength of the electron emission portion in the direction (a direction parallel to the electron emission surface) of action of principal stress loading in normal use is improved. Thus, a deterioration of the electron emission characteristics of the emitter and a reduction in the lifetime of the emitter resulting from the creep deformation are suppressed.

PRIOR ART

Patent Document

Patent Document 1: National Patent Publication Gazette No. 2010-534396

SUMMARY OF THE INVENTION

Problems to be Solved by the Invention

Although the X-ray tube device according to the aforementioned National Patent Publication Gazette No. 2010-534396 is configured such that the orientation of the crystal grains of the electron emission portion is aligned in the prescribed direction in terms of a material in order to improve the mechanical strength in the direction parallel to the electron emission surface, there is such a problem that it is difficult to sufficiently suppress the phenomenon (sagging phenomenon) where the electron emission portion is sunk by the creep deformation associated with prolonged use to be deformed in the structure in which the vicinities of both ends of the flat plate-like electron emission portion are supported by the pair of terminal portions. When the electron emission portion is sunk by the sagging phenomenon, the convergence of electrons emitted from the emitter is reduced, and hence the focal point diameter of an X-ray emitted from the X-ray tube device cannot fall within a desired range. Thus, in order to maintain a desired X-ray focal point diameter over a longer period of time and further increase the lifetime of the emitter, it is desirable to sufficiently suppress sinking of the electron emission portion.

The present invention has been proposed in order to solve the aforementioned problems, and an object of the present invention is to provide an X-ray tube device and a method for using an X-ray tube device each capable of sufficiently suppressing sinking of an electron emission portion resulting from creep deformation associated with use.

Means for Solving the Problems

In order to attain the aforementioned object, an X-ray tube device according to a first aspect of the present invention includes an anode and a cathode including an emitter emitting an electron to the anode, and the emitter includes an electron emission portion in a flat plate shape, a pair of terminal portions extending from the electron emission portion, connected to an electrode, and a supporting portion provided separately from the terminal portions, insulated from the electrode, supporting the electron emission portion.

In the X-ray tube device according to the first aspect of the present invention, as hereinabove described, the emitter is provided with the supporting portion provided separately from the terminal portions, insulated from the electrode, supporting the electron emission portion, whereby the electron emission portion in the flat plate shape can be structurally supported by not only the terminal portions but also the supporting portion provided separately from the terminal portions. Thus, sinking (sagging phenomenon) of the electron emission portion structurally inevitably generated in the electron emission portion in the flat plate shape, resulting from creep deformation associated with use can be sufficiently suppressed by the supporting portion, which is not material but structural means. Furthermore, the dedicated supporting portion insulated from the electrode is provided, whereby the supporting portion can easily support the electron emission portion without obstructing a current pathway flowing from the electrode to the electron emission portion through the terminal portions.

In the aforementioned X-ray tube device according to the first aspect, the supporting portion is preferably arranged to support the vicinity of a deformed portion of the electron emission portion where the degree of variation of flatness of the electron emission portion resulting from creep deformation associated with the use of the emitter is relatively large. According to this structure, the sinking (sagging phenomenon) of the electron emission portion can be effectively suppressed by supporting the vicinity of the deformed portion where the variation of flatness is large.

In this description, the "flatness" denotes the amount of deviation of the electron emission portion from each of upper and lower reference surfaces in a projection view in a lateral direction parallel to the electron emission portion, setting the upper and lower surfaces of the ideal electron emission portion in an undeformed state as the reference surfaces. The upper surface of the electron emission portion is set as an electron emission surface, and the lower surface thereof is set as a surface opposite to the electron emission surface. The "deformed portion" is a portion of the electron emission portion where the degree of variation of flatness is relatively large in the case where a state of providing no supporting portion is assumed. The position of the deformed portion in the electron emission portion is determined according to the shape of the electron emission portion and can be derived by a simulation, for example. According to the present invention, the "vicinity of the deformed portion" includes the deformed portion and a region in the vicinity of the deformed portion.

In the aforementioned structure in which the supporting portion supports the vicinity of the deformed portion, the electron emission portion is preferably formed in the flat plate shape by a current path which is winding, and the supporting portion is preferably arranged to support the current path on the outer peripheral side of the electron emission portion including the deformed portion. In the case where the electron emission portion is formed in the flat plate shape by the current path which is winding, as described above, the deformed portion whose flatness is easily varied structurally exists in the current path of the electron emission portion on the outer peripheral side (the current path on the outer peripheral side is easily creep-deformed). Thus, the supporting portion is arranged to structurally support the current path on the outer peripheral side as in the present invention, whereby the sinking (sagging phenomenon) of the electron emission portion can be more effectively suppressed.

In the aforementioned structure in which the supporting portion supports the current path on the outer peripheral side of the electron emission portion, the current path preferably includes at least a first portion on the outer peripheral side extending from one of the terminal portions toward the other of the terminal portions and a second portion extending from the other of the terminal portions toward one of the terminal portions on an inner peripheral side with respect to the first portion continuously from the first portion, and the supporting portion is preferably arranged to support the vicinity of a connection portion between the first portion and the second portion. In the case where the current path is windingly formed to include the first portion on the outer peripheral side and the second portion on the inner peripheral side, as described above, the vicinity of the connection portion between the first portion and the second portion becomes a portion whose flatness is particularly easily varied. Thus, the supporting portion is arranged to support the vicinity of the connection portion between the first portion and the second portion as in the present invention, whereby the vicinity of a part of the deformed portion whose flatness is particularly easily varied can be structurally supported, and hence the sinking (sagging phenomenon) of the electron emission portion can be reliably and more effectively suppressed.

In the aforementioned X-ray tube device according to the first aspect, the supporting portion is preferably formed to extend to the same side as that of the terminal portions in a direction intersecting with the electron emission portion, and one end thereof is preferably fixed while the other end thereof is coupled to the electron emission portion or is arranged at a position in contact with the electron emission portion. According to this structure, it is only required to add the supporting portion on the side of the emitter closer to the terminal portions, and hence the supporting portion can be structurally easily provided. The supporting portion is only required to support the electron emission portion, and hence the supporting portion may only come into contact with the electron emission portion from the same side as that of the terminal portions to support the same without being coupled and fixed to the electron emission portion.

In the aforementioned X-ray tube device according to the first aspect, the supporting portion is preferably formed in the flat plate shape integrally with the electron emission portion by pulling out from an outer peripheral portion of the electron emission portion in the flat plate shape and bending to the same side as that of the terminal portions. According to this structure, the supporting portion and the electron emission portion can be integrally formed of a common flat plate material, and hence the supporting portion can be easily formed. Furthermore, the supporting portion can be provided without an increase in the number of components, unlike the case where the supporting portion and the electron emission portion are provided separately from each other.

The aforementioned X-ray tube device according to the first aspect preferably further includes a tubular enclosure housing the emitter and a target as the anode, rotating about a central axis, and a pair of supporting portions are preferably provided at positions opposed to each other through the central axis. According to this structure, in the so-called enclosure rotation type X-ray tube device in which the emitter rotates together with the enclosure, a mechanical balance about the rotation central axis can be maintained even in the case where the supporting portions are provided in the emitter, and hence the deformation can be suppressed while the rotation of the emitter in use (during rotation) is stabilized.

In the aforementioned X-ray tube device according to the first aspect, the electron emission portion preferably has a protrusion portion protruding in a direction opposite to the deformation direction of a deformed portion in a region including the deformed portion where the degree of variation of flatness of the electron emission portion resulting from creep deformation associated with the use of the emitter. According to this structure, the protrusion portion protruding in the direction opposite to the deformation direction can cancel out the variation of flatness even when the creep deformation is generated in the electron emission portion. Thus, while the supporting portion suppresses deformation, the protrusion portion can cancel out additional deformation even when the deformation is further generated, and hence sinking of the electron emission portion can be more sufficiently suppressed.

In this case, the protrusion portion preferably protrudes in a direction opposite to a direction of action of gravity in use. According to this structure, the protrusion portion can cancel out the creep deformation of the electron emission portion resulting from gravity constantly acting on the emitter.

In the aforementioned structure in which the electron emission portion has the protrusion portion, the electron emission portion is preferably formed in the flat plate shape by a current path which is winding, and the protrusion portion is preferably arranged in the current path on the outer peripheral side of the electron emission portion including the deformed portion. According to this structure, the deformed portion whose flatness is easily varied structurally exists in the current path of the electron emission portion on the outer peripheral side, and hence the sinking (sagging phenomenon) of the portion whose flatness is easily varied in the electron emission portion can be effectively canceled out.

In this case, the current path preferably includes at least a first portion on the outer peripheral side extending from one of the terminal portions toward the other of the terminal portions and a second portion extending from the other of the terminal portions toward one of the terminal portions on an inner peripheral side with respect to the first portion continuously from the first portion, and the protrusion portion is preferably formed by inclining the first portion such that the vicinity of a connection portion between the first portion and the second portion protrudes. According to this structure, the vicinity of the connection portion between the first portion and the second portion structurally becomes the portion whose flatness is particularly easily varied, and hence the sinking (sagging phenomenon) of the vicinity of the part of the deformed portion whose flatness is particularly easily varied in the electron emission portion can be reliably and more effectively canceled out.

In the aforementioned X-ray tube device according to the first aspect, the electron emission portion is preferably formed in the flat plate shape by a current path which is winding and has a wide portion whose path width is larger than those of other portions of the current path, and the wide portion is preferably arranged in a region including a deformed portion where the degree of variation of flatness of the electron emission portion resulting from creep deformation associated with the use of the emitter is relatively large. According to this structure, the mechanical strength of the current path (wide portion) in the region including the deformed portion can be relatively improved as compared with that of other portions. Thus, while the supporting portion suppresses deformation, the wide portion can further suppress deformation, and hence the sinking of the electron emission portion can be more sufficiently suppressed.

In this case, the wide portion is preferably arranged in the current path on the outer peripheral side of the electron emission portion including the deformed portion. According to this structure, the deformed portion whose flatness is easily varied structurally exists in the current path of the electron emission portion on the outer peripheral side, and hence the sinking (sagging phenomenon) of the portion whose flatness is easily varied in the electron emission portion can be effectively suppressed.

In the aforementioned structure in which the wide portion is arranged in the current path on the outer peripheral side, the electron emission portion preferably includes at least a first portion on the outer peripheral side extending from one of the terminal portions toward the other of the terminal portions and a second portion extending from the other of the terminal portions toward one of the terminal portions on an inner peripheral side with respect to the first portion continuously from the first portion, and the wide portion is preferably formed in the first portion including the vicinity of a connection portion between the first portion and the second portion. According to this structure, the vicinity of the connection portion between the first portion and the second portion structurally becomes the deformed portion whose flatness is particularly easily varied, and hence the sinking (sagging phenomenon) of the vicinity of the part of the deformed portion whose flatness is particularly easily varied in the electron emission portion can be reliably and more effectively suppressed.

A method for using an X-ray tube device according to a second aspect of the present invention is a method for using an X-ray tube device including an anode and a cathode including an emitter emitting an electron to the anode, in which the emitter includes an electron emission portion in a flat plate shape, a pair of terminal portions extending from the electron emission portion, connected to an electrode, and a supporting portion provided separately from the terminal portions, insulated from the electrode, supporting the electron emission portion, and includes steps of emitting the electron in a state where the emitter is oriented in a first direction along a gravity direction to be opposed to the anode and generating an X-ray and applying an electric current to at least the emitter to heat the emitter in a state where the emitter is oriented in a second direction along the gravity direction, opposite to the first direction to be opposed to the anode.

In the method for using an X-ray tube device according to the second aspect of the present invention, as hereinabove described, the X-ray tube device including the emitter including the supporting portion provided separately from the terminal portions, insulated from the electrode, supporting the electron emission portion is used, whereby the electron emission portion in the flat plate shape can be structurally supported by not only the terminal portions but also the supporting portion provided separately from the terminal portions, and hence sinking of the electron emission portion resulting from creep deformation associated with use can be sufficiently suppressed. Furthermore, according to the present invention, at least the emitter is applied with an electric current to be heated in the state where the emitter is oriented in the second direction along the gravity direction, opposite to the first direction to be opposed to the anode, whereby the sinking of the electron emission portion resulting from the creep deformation (deformation generated by applying an electric current to the emitter to heat the same in the first direction) generated in the step of generating an X-ray in normal use can be canceled out by deformation in the opposite direction generated by applying an electric current to the emitter to heat the same in the opposite second direction. Thus, the sinking of the electron emission portion resulting from the creep deformation associated with use can be more sufficiently suppressed.

A method for using an X-ray tube device according to a third aspect of the present invention is a method for using an X-ray tube device including an anode and an emitter having an electron emission portion in a flat plate shape emitting an electron to the anode, and includes steps of emitting the electron in a state where the emitter is oriented in a first direction along a gravity direction to be opposed to the anode and generating an X-ray and applying an electric current to at least the emitter to heat the emitter in a state where the emitter is oriented in a second direction along the gravity direction, opposite to the first direction to be opposed to the anode.

In the method for using an X-ray tube device according to the third aspect of the present invention, as hereinabove described, at least the emitter is applied with an electric current to be heated in the state where the emitter is oriented in the second direction along the gravity direction, opposite to the first direction to be opposed to the anode, whereby sinking of the electron emission portion resulting from creep deformation (deformation generated by applying an electric current to the emitter to heat the same in the first direction) generated in the step of generating an X-ray in normal use can be canceled out by deformation in the opposite direction generated by applying an electric current to the emitter to heat the same in the opposite second direction. Thus, the creep deformation of the electron emission portion in use can be canceled out, and hence the sinking of the electron emission portion resulting from the creep deformation associated with use can be sufficiently suppressed.

In the aforementioned method for using an X-ray tube device according to the third aspect, the step of applying an electric current to at least the emitter to heat the emitter in the state where the emitter is oriented in the second direction is preferably carried out under the same condition as that of application of an electric current to the emitter to heat the emitter in the step of generating an X-ray for a time substantially equal to a time to apply an electric current to the emitter to heat the emitter in the step of generating an X-ray. According to this structure, the amount of deformation substantially equal to the amount of deformation of the electron emission portion generated in normal use can be generated in the opposite direction by the step of applying an electric to the emitter to heat the same in the second direction. Thus, the sinking of the electron emission portion can be effectively suppressed, and excessive deformation in the opposite direction can be prevented by the step of applying an electric current to the emitter to heat the same in the second direction.

An X-ray tube device according to a fourth aspect of the present invention includes an anode and a cathode including an emitter emitting an electron to the anode, the emitter includes an electron emission portion in a flat plate shape, and a pair of terminal portions extending from both ends of the electron emission portion, connected to an electrode, and the electron emission portion has a protrusion portion protruding in a direction opposite to the deformation direction of a deformed portion in a region including the deformed portion where the degree of variation of flatness of the electron emission portion resulting from creep deformation associated with the use of the emitter is relatively large.

In the X-ray tube device according to the fourth aspect of the present invention, as hereinabove described, the electron emission portion is provided with the protrusion portion protruding in the direction opposite to the deformation direction of the deformed portion in the region including the deformed portion where the degree of variation of flatness of the electron emission portion resulting from the creep deformation associated with the use of the emitter is relatively large, whereby the protruding portion protruding in the direction opposite to the deformation direction can cancel out the variation of flatness even when the creep deformation is generated in the electron emission portion. Thus, the variation of flatness in the region including the deformed portion can be canceled out, and hence sinking of the electron emission portion resulting from the creep deformation associated with use can be sufficiently suppressed.

An X-ray tube device according to a fifth aspect of the present invention includes an anode and a cathode including an emitter emitting an electron to the anode, the emitter includes an electron emission portion formed in a flat plate shape by a current path which is winding, having a wide portion whose path width is larger than those of other portions of the current path, and a pair of terminal portions extending from both ends of the electron emission portion, connected to an electrode, and the wide portion is arranged in a region including a deformed portion where the degree of variation of flatness of the electron emission portion resulting from creep deformation associated with the use of the emitter is relatively large.

In the X-ray tube device according to the fifth aspect of the present invention, as hereinabove described, the wide portion is arranged in the region including the deformed portion where the degree of variation of flatness of the electron emission portion resulting from the creep deformation associated with the use of the emitter is relatively large, whereby the mechanical strength of the current path (wide portion) in the region including the deformed portion can be relatively improved as compared with that of other portions. Thus, generation of the deformation in the region (wide portion) including the deformed portion can be suppressed, and hence sinking of the electron emission portion resulting from the creep deformation associated with use can be sufficiently suppressed.

Effect of the Invention

As hereinabove described, according to the present invention, the X-ray tube device and the method for using an X-ray tube device each capable of sufficiently suppressing the sinking of the electron emission portion resulting from the creep deformation associated with use can be provided.

BRIEF DESCRIPTION OF THE DRAWINGS

FIG. 6 A schematic view showing simulation results of variation of flatness in an emitter according to Comparative Example.

FIG. 7 A schematic view showing simulation results of variation of flatness in an emitter according to Example of the present invention.

MODES FOR CARRYING OUT THE INVENTION

Embodiments are hereinafter described on the basis of the drawings.

First Embodiment

The structure of an X-ray tube device 100 according to a first embodiment is now described with reference to FIGS. 1 to 3.

Figure 1:
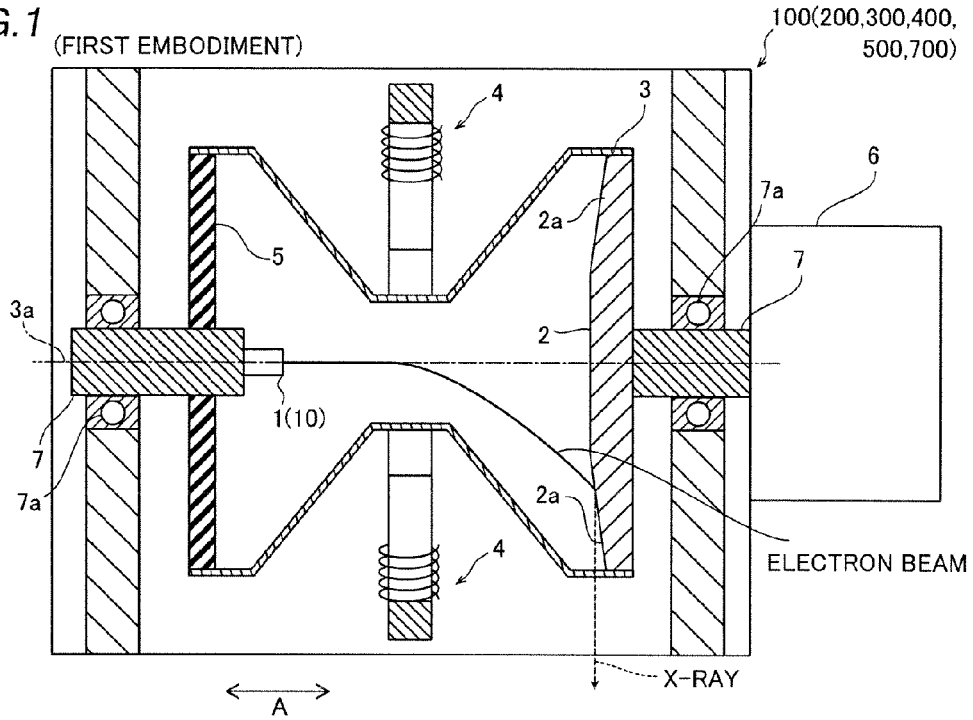
FIG. 1 A schematic longitudinal sectional view showing the overall structure of an X-ray tube device according to a first embodiment of the present invention.

The X-ray tube device 100 includes an electron source 1 generating an electron beam, a target 2, an enclosure 3 internally housing the electron source 1 and the target 2, and a magnetic field generator 4 provided outside the enclosure 3, as shown in FIG. 1. According to the first embodiment, the X-ray tube device 100 is a rotating anode X-ray tube device in which the target 2 rotates, and more specifically an enclosure rotation type X-ray tube device in which the enclosure 3 rotates integrally with the target 2 the enclosure 3. The electron source 1 and the target 2 are examples of the "cathode" and the "anode" in the present invention, respectively.

The electron source 1 is fixedly mounted on one end of the enclosure 3 in an axial direction (direction A) through an insulating member 5. The electron source 1 is arranged on the rotation axis 3*a* of the enclosure 3 and is configured to rotate integrally with the enclosure 3 about the rotation axis 3*a*. The electron source 1 includes an emitter 10 and a pair of electrodes 1*a* for applying an electric current to the emitter 10 to heat the same, as shown in FIG. 2. The structure of the emitter 10 is described later.

As shown in FIG. 1, the target 2 is integrally (fixedly) mounted on the other end of the enclosure 3 in the axial direction (direction A) to be opposed to the electron source 1. The target 2 has a disc shape inclined such that the edge 2*a* is thinned outward. The center of the target 2 coincides with the rotation axis 3*a* of the enclosure 3, and the target 2 is configured to rotate integrally with the enclosure 3 about the rotation axis 3*a*.

The target 2 and the electron source 1 are connected to a positive terminal and a negative terminal of an unshown power source portion, respectively. A positive high voltage is applied to the target 2, and a negative high voltage is applied to the electron source 1, whereby the electron beam is generated from the electron source 1 toward the target 2 along the rotation axis 3*a* (axial direction A).

The enclosure 3 has a tubular shape extending in the axial direction A about the rotation axis (central axis) 3*a*. The enclosure 3 is supported by shafts 7 and bearings 7*a* provided on both ends to be rotatable about the rotation axis 3*a*. The enclosure 3 is drivingly rotated by a motor 6 coupled to the shaft 7. One end of the enclosure 3 is sealed by the disc-shaped insulating member 5, and the other end of the enclosure 3 is sealed by the target 2. The inside of the enclosure 3 is evacuated. The enclosure 3 is made of a non-magnetic metal material such as stainless steel (SUS), and the insulating member 5 is made of an insulating material such as ceramic.

The magnetic field generator 4 includes a plurality of magnetic poles arranged on an annular core and coils wound around the magnetic poles. The magnetic field generator 4 has a function of generating a magnetic field for focusing and deflecting the electron beam from the electron source 1 toward the target 2. As shown in FIG. 1, the electron beam toward the target 2 along the axial direction A is focused and deflected by the action of the magnetic field generated from the magnetic field generator 4 and hits the inclined edge 2*a* of the target 2. Consequently, an X-ray is generated from the edge 2*a* of the target 2 and is externally emitted through an unshown window portion of the enclosure 3.

The structure of the emitter 10 of the electron source 1 is now described in detail. As shown in FIGS. 2 to 5, the emitter 10 is made of pure tungsten or a tungsten alloy and integrally has a flat plate-like electron emission portion 11, a pair of terminal portions 12, and a pair of supporting portions 13. According to the first embodiment, the electron emission portion 11, the pair of terminal portions 12, and the pair of supporting portions 13 are cut from a single flat plate material and are integrally formed by bending.

The emitter 10 is a so-called thermionic emitter and is configured to be applied with an electric current from the electrodes 1*a* through the pair of terminal portions 12 to be heated. Thus, the flat plate-like electron emission portion 11 is applied with a prescribed electric current to be heated to a prescribed temperature (about 2400 K to about 2500 K), whereby the electron emission portion 11 emits an electron.

Figure 2:
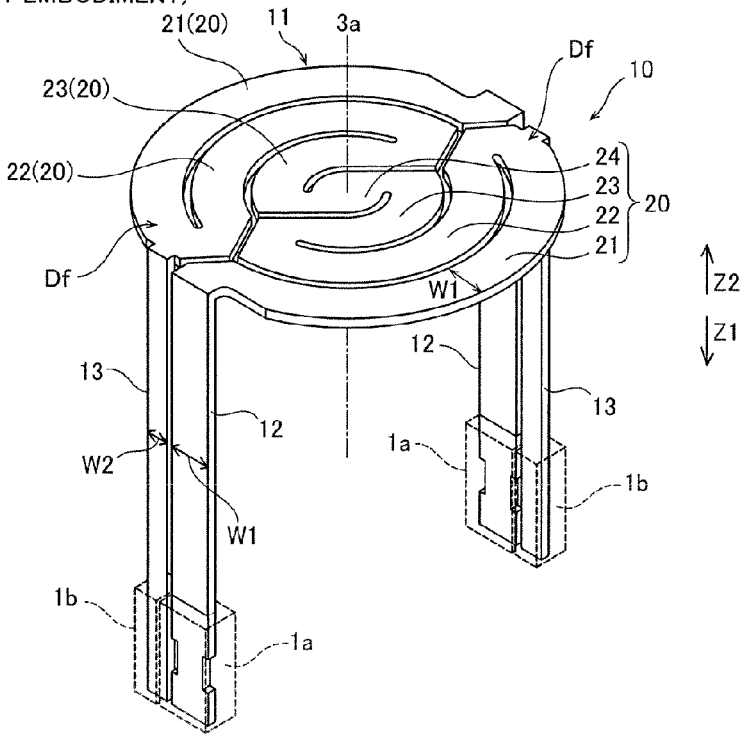
FIG. 2 A schematic perspective view showing an emitter of the X-ray tube device according to the first embodiment of the present invention.
Figure 3:
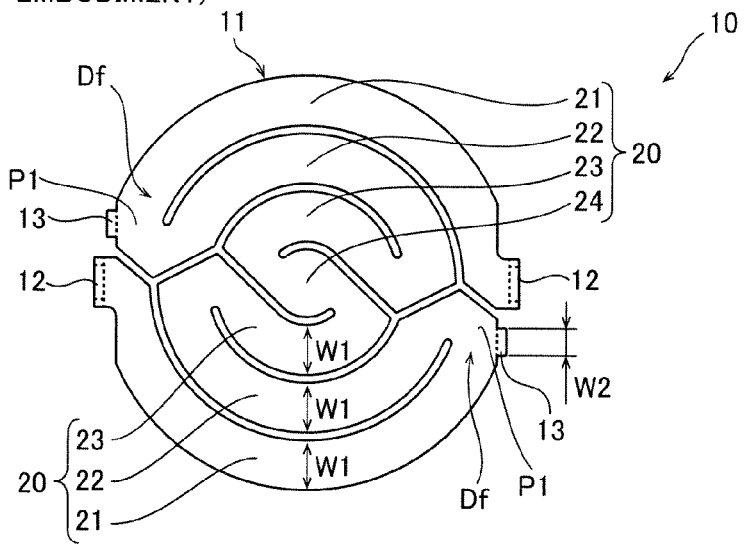
FIG. 3 A top plan view (plan view) showing an electron emission portion of the emitter shown in FIG. 2.

As shown in FIGS. 2 and 3, the electron emission portion 11 is formed in a flat plate shape by a winding (meandering) current path 20 and is formed in a circular shape in a plan view. A central portion 24 of the electron emission portion 11 coincides with the rotation axis 3*a* of the enclosure 3, and the emitter 10 rotates about the central portion 24 (rotation axis 3*a*) following the rotation of the enclosure 3.

The current path 20 is formed with a substantially constant path width W1 and is connected to the terminal portions 12 on both ends of the current path 20. The current path 20 includes first portions 21, second portions 22, third portions 23, and the central portion 24. A pair of first portions 21 are outer peripheral portions provided to extend in an arcuate shape from one (the other) terminal portion 12 toward the other (one) terminal portion 12. The second portions 22 are provided to extend in an arcuate shape toward the opposite terminal portions 12 on the inner peripheral side with respect to the first portions 21 continuously from the first portions 21. The third portions 23 are provided to further extend in an arcuate shape toward the opposite sides continuously from the second portions 22 and to be connected to the central portion 24.

Figure 4:
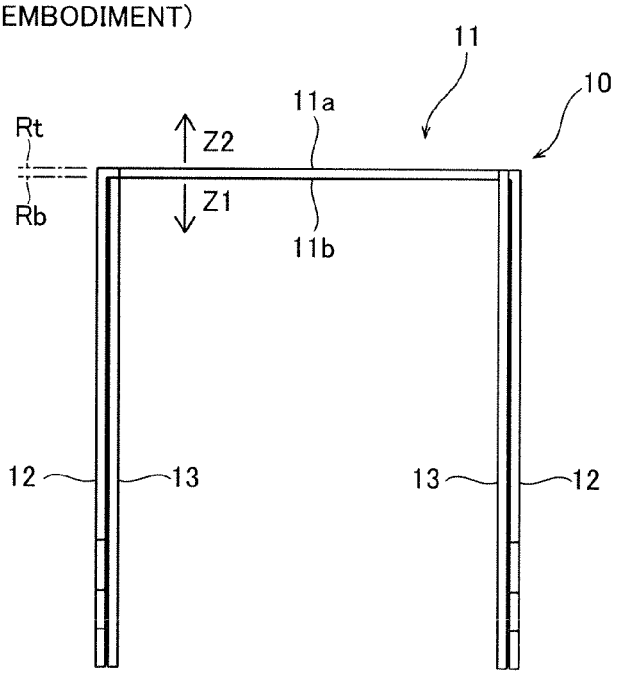
FIG. 4 A side elevational view (front elevational view) of the emitter shown in FIG. 2.
Figure 5:
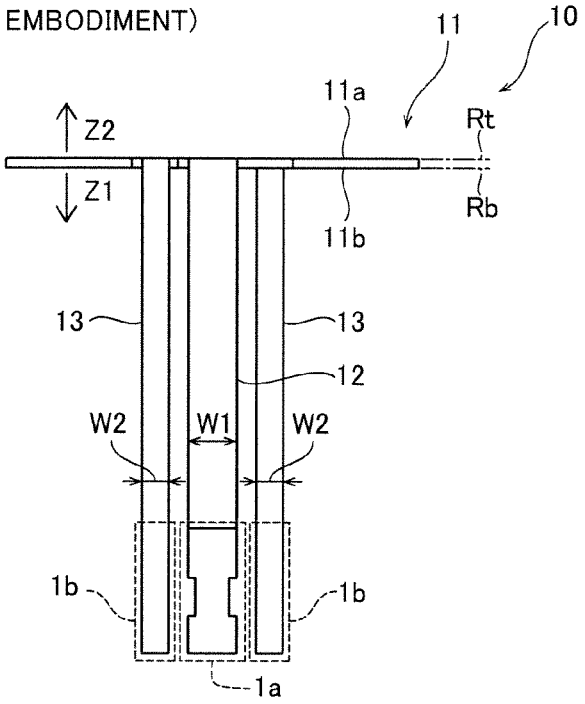
FIG. 5 A side elevational view of the emitter shown in FIG. 2 as viewed from the side of a terminal portion.

As shown in FIGS. 2, 4, and 5, the pair of terminal portions 12 extend from ends of the current path 20 (electron emission portion 11) and are formed by bending in a direction Z1, and ends of the terminal portions 12 are fixed to the electrodes 1*a* of the electron source 1. The terminal portions 12 serve as connection terminals with the electrodes 1*a* for applying an electric current to the electron emission portion 11 to heat the same and have a function of supporting the electron emission portion 11 by being fixed to the electrodes 1*a*. The terminal portions 12 each have a flat plate shape with a width equal to the path width (W1) of the current path 20.

As shown in FIGS. 2 to 5, the pair of supporting portions 13 are provided separately from the terminal portions 12, are insulated from the electrodes 1*a*, and are formed to support the electron emission portion 11. The pair of supporting portions 13 are arranged to be opposed to each other through the rotation axis (central axis) 3*a* of the enclosure 3 in a plan view. These supporting portions 13 extend from prescribed portions of the current path 20 (electron emission portion 11) and are formed in a flat plate shape by bending in the same direction Z1 as that of the terminal portions 12. Ends of the supporting portions 13 are fixed by fixing members 1*b* provided on a base portion (not shown) of the electron source 1. The fixing members 1*b* are insulated from the electrodes 1*a*. The ends of the supporting portions 13 may be directly fixed to the base portion (not shown) of the electron source 1. Illustration of the electrodes 1*a* and the fixing members 1*b* is omitted in FIGS. 3 and 4.

The supporting portions 13 each have a width W2 smaller than the path width W1 of each of the terminal portions 12 and the current path 20, and according to the first embodiment, the width W2 is about a half of the width W1. The width W2 of each of the supporting portions 13 is only required to be equal to or larger than that required to obtain strength capable of supporting the electron emission portion 11. In order to be capable of suppressing escape of the heat of the electron emission portion 11, which has been applied with an electric current to be heated, to the supporting portions 13, the width W2 of each of the supporting portions 13 is preferably smaller.

According to the first embodiment, the supporting portions 13 are arranged to support the vicinities of deformed portions Df of the electron emission portion 11 (current path 20) where the degree of variation of the flatness of the electron emission portion 11 resulting from creep deformation (sagging phenomenon) associated with the use of the emitter 10 is relatively large.

The deformed portions Df of the electron emission portion 11 are determined by the shape of the electron emission portion and can be derived by a computational method such as a simulation, for example. FIG. 6 shows simulation results (Comparative Example) for evaluating the creep deformation of the emitter in the case where no supporting portion 13 is provided. The creep deformation of the electron emission portion is generated mainly by a high temperature at the time of applying an electric current to the emitter to heat the same and external force (gravity, inertial force related to centrifugal force, or the like) acting on the electron emission portion. However, strictly speaking, slip or the like of metal crystal grains constituting the emitter is generated, and hence it is difficult to accurately reproduce the creep deformation by the simulation. Therefore, the magnitude of gravity was adjusted to obtain deformation equivalent to experimentally confirmed creep deformation after ten thousand exposures (X-ray irradiation), taking into consideration only the creep deformation generated by gravity, whereby the creep deformation was reproduced.

In FIG. 6, the degree of the creep deformation (sagging phenomenon) is evaluated by flatness. The flatness is the amount of deviation of the electron emission portion 11 from each of an upper (the side of an electron emission surface) reference surface Rt and a lower (a side opposite to the electron emission surface) reference surface Rb in a projection view (see FIG. 4) as viewed from a side parallel to the electron emission portion 11. Therefore, in an undeformed state, the upper surface (electron emission surface) 11*a* of the electron emission portion 11 coincides with the upper reference surface Rt and the flatness is +0 while the lower surface 11*b* of the electron emission portion 11 coincides with the lower reference surface Rb and the flatness is −0. It is assumed that the flatness is +X if the upper surface 11*a* of the electron emission portion 11 is deviated by X in a direction Z2 (upper surface side) due to the sagging phenomenon, and the flatness is −Y if the lower surface 11*b* is deviated by Y in the direction Z1 (lower surface side). In the simulation, a gravity direction (vertically downward) G2 coincides with the direction Z1 (flatness minus direction) from the upper surface 11*a* toward the lower surface 11*b*.

In the case where no supporting portion 13 is provided, as shown in FIG. 6, the flatness of the electron emission portion 11 is significantly varied in the current path 20 of the electron emission portion 11 on the outer peripheral side (see dark hatched regions in FIG. 6). Specifically, regions around connection portions P1 of the current path 20 between the first portions 21 and the second portions 22 (about halve of the first portions 21 and about halve of the second portions 22 with respect to the connection portions P1) become the deformed portions Df where the variation of flatness is relatively large. Although the same hatching is denoted, the variation of flatness is maximized (−52 μm) in the connection portions P1 of the deformed portions Df. This result is easily understood also from that the electron emission portion 11 has a structure of supporting the weights of the second portions 22, the third portions 23, and the central portion 24 on the inner peripheral side by ends (the connection portions P1 with the second portions 22) of the first portions 21 supported by the pair of terminal portions 12.

On the basis of the aforementioned simulation results (Comparative Example), according to the first embodiment, the supporting portions 13 are the current path 20 on the outer peripheral side of the electron emission portion 11 and are arranged to support the vicinities of the connection portions P1 (deformed portions Df) between the first portions 21 and the second portions 22.

According to the first embodiment, as hereinabove described, the supporting portions 13 provided separately from the terminal portions 12, insulated from the electrodes 1*a*, supporting the electron emission portion 11 is provided, whereby the flat plate-like electron emission portion 11 can be structurally supported by not only the terminal portions 12 but also the supporting portions 13 provided separately from the terminal portions 12. Thus, sinking (sagging phenomenon) of the electron emission portion 11 resulting from the creep deformation associated with use can be sufficiently suppressed by the supporting portions 13, which are not material but structural means. Furthermore, it is only required to provide the dedicated supporting portions 13 insulated from the electrodes 1*a*, and hence the supporting portions 13 can easily support the electron emission portion 11 without obstructing current pathways flowing from the electrodes 1*a* to the electron emission portion 11 through the terminal portions 12.

According to the first embodiment, as hereinabove described, the supporting portions 13 are arranged to support the vicinities of the deformed portions Df of the electron emission portion 11 where the degree of variation of the flatness of the electron emission portion 11 resulting from the creep deformation associated with the use of the emitter 10 is relatively large. Thus, the sinking (sagging phenomenon) of the electron emission portion 11 can be effectively suppressed by supporting the vicinities of the deformed portions Df where the variation of flatness is large.

According to the first embodiment, as hereinabove described, the supporting portions 13 are arranged to support the vicinities of the connection portions P1 between the first portions 21 and the second portions 22 on the outer peripheral side. Thus, the vicinities of the connection portions P1 whose flatness is the most easily varied can be structurally supported, and hence the sinking (sagging phenomenon) of the electron emission portion 11 can be reliably and more effectively suppressed.

According to the first embodiment, as hereinabove described, the supporting portions 13 are formed in the flat plate shape integrally with the electron emission portion 11 by pulling out from the outer peripheral portion of the flat plate-like electron emission portion 11 and bending to the same side as that of the terminal portions 12. Thus, the supporting portions 13 and the electron emission portion 11 can be integrally formed of the common flat plate material, and hence the supporting portions 13 can be easily formed. Furthermore, the supporting portions 13 can be provided without an increase in the number of components, unlike the case where the supporting portions 13 and the electron emission portion 11 are provided separately from each other.

According to the first embodiment, as hereinabove described, the pair of supporting portions 13 are provided at positions opposed to each other through the rotation axis (central axis) 3*a*. Thus, in the enclosure rotation type X-ray tube device 100 in which the emitter 10 rotates together with the enclosure 3, a mechanical balance about the rotation axis (central axis) 3*a* can be maintained even in the case where the supporting portions 13 are provided in the emitter 10, and hence the deformation can be suppressed while the rotation of the emitter 10 in use (during rotation) is stabilized.

EXAMPLE

Results of a simulation (Example) conducted in order to confirm effects of the X-ray tube device 100 according to the first embodiment are now described with reference to FIG. 7.

The results of the simulation (Example) in FIG. 7 denote results of a simulation conducted on the emitter 10 according to the aforementioned first embodiment, in which the supporting portions 13 are provided, under the same conditions as those of the simulation results shown in FIG. 6 (Comparative Example in which no supporting portion 13 is provided).

As shown in FIG. 7, in Example, the amount of variation of flatness in the connection portions P1 of the deformed portions Df where the amount of variation of flatness was maximized in FIG. 6 was 0 μm (no variation of flatness). In Example, the variation of flatness in the connection portions P1 was suppressed, and hence the variation of flatness was maximized in the connection portions P2 between the second portions 22 and the third portions 23 on the inner peripheral side, in which the amount of variation was −13 μm. Thus, it has been confirmed that the maximum amount of variation of flatness resulting from the sagging phenomenon is reduced from −52 μm (Comparative Example) in the connection portions P1 having no supporting portion to −13 μm (Example) in the connection portions P2.

The flatness of the connection portions P2 was −36 in Comparative Example shown in FIG. 6. Therefore, when the variation of flatness was viewed with respect to each portion, the amount of variation of flatness in the connection portions P1 was reduced from −52 μm (Comparative Example) to 0 μm (Example), and the amount of variation of flatness in the connection portions P2 was reduced from −36 μm (Comparative Example) to −13 μm (Example). It has been confirmed from these results that the variation of flatness resulting from the creep deformation is sufficiently suppressed over the entire electron emission portion 11 including the deformed portions Df by providing the supporting portions 13.

Modification of First Embodiment

In the aforementioned first embodiment, the example of forming the supporting portions 13 integrally with the current path 20 (electron emission portion 11) has been shown, but in a modification of the first embodiment, supporting portions are provided separately from a current path 20 (electron emission portion 11).

Figure 8:
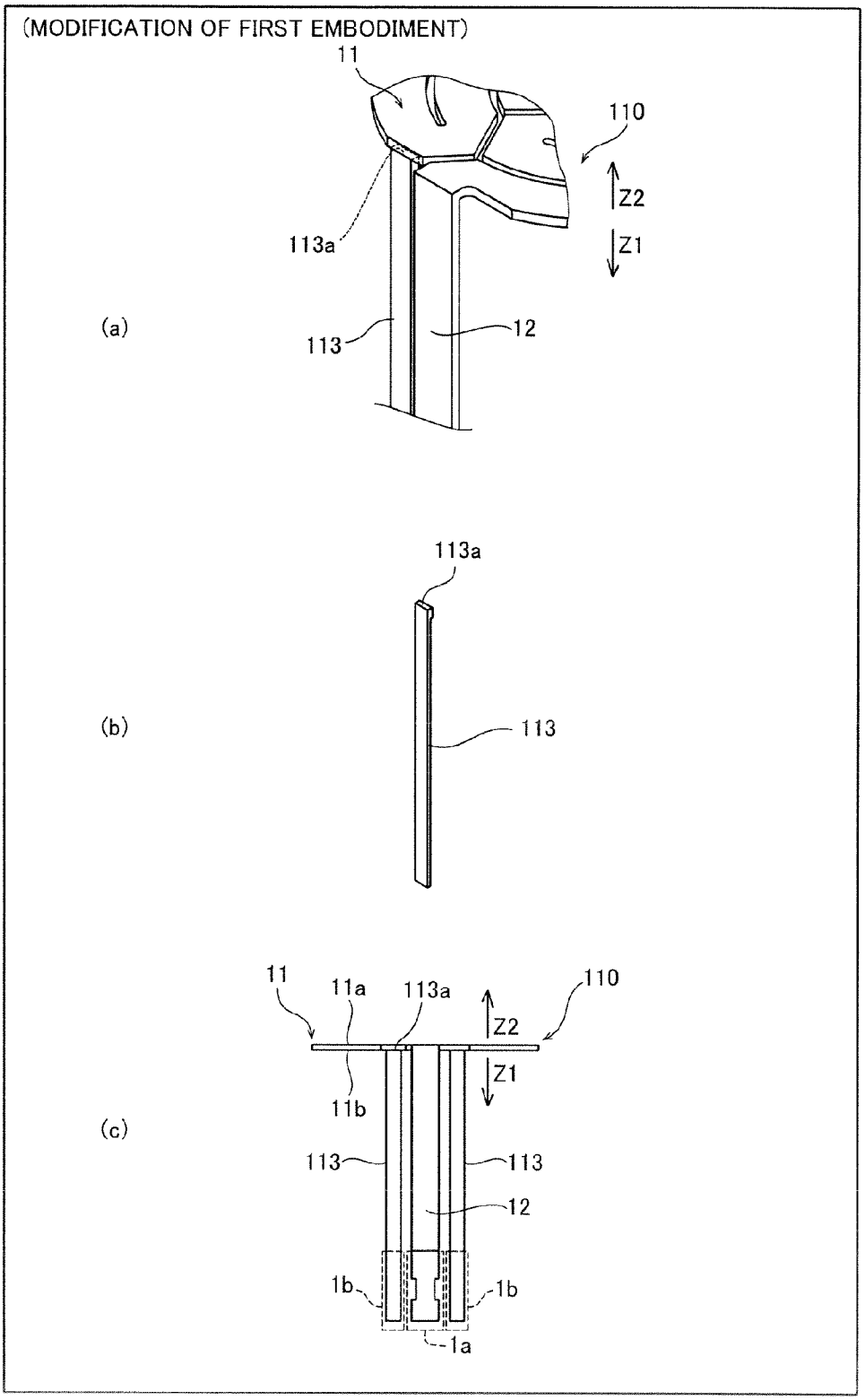
FIG. 8 A schematic view for illustrating an emitter according to a modification of the first embodiment of the present invention.

In an emitter 110 according to the modification of the first embodiment, supporting portions 113 are formed to extend to the side of a lower surface 11*b* (in a direction Z1), which is the same as that of terminal portions 12, in a direction intersecting with (orthogonal to) the electron emission portion 11, as shown in view (a) and view (c) of FIG. 8. One ends of the supporting portions 113 are fixed by fixing members 1*b* provided on a base portion (not shown) of an electron source 1, and the other ends 113*a* (see view (b) of FIG. 8) of the supporting portions 113 are fixedly coupled to the electron emission portion 11 or are arranged at positions in contact with the lower surface 11*b* of the electron emission portion 11. In other words, the supporting portions 113 are only required to support the electron emission portion 11 in order to be capable of suppressing the creep deformation of the electron emission portion 11, and it is not necessary to fix the supporting portions 113 to the electron emission portion 11. FIG. 8 shows an example of bringing the other ends 113*a* of the supporting portions 113 into contact with the lower surface 11*b* of the electron emission portion 11.

According to this modification of the first embodiment, the supporting portions 113 are formed separately from the electron emission portion 11, and hence the supporting portions 113 may be made of a material (a material other than tungsten and a tungsten alloy) different from that for the electron emission portion 11. The supporting portions 113 may be made of a metal material having a high melting point other than tungsten, such as molybdenum, a ceramic material such as alumina ($Al_2O_3$) or silicon nitride ($Si_3N_4$), or the like, for example. Furthermore, the supporting portions 113 may be formed in a shape other than a flat plate shape, such as a columnar shape.

According to this modification of the first embodiment, it is only required to add the supporting portions 13 on the side of the emitter 110 closer to the terminal portions 12, and hence the supporting portions 113 can be structurally easily provided.

Second Embodiment

An emitter 210 or 230 of an X-ray tube device 200 (see FIG. 1) according to a second embodiment of the present invention is now described with reference to FIGS. 1, 9, and 10. In the second embodiment, an example of configuring deformed portions Df of an electron emission portion 11 to protrude in a direction opposite to the deformation direction (gravity direction) of creep deformation, in addition to the structure of the aforementioned first embodiment in which the supporting portions 13 are provided in the electron emission portion 11, is described. According to the second embodiment, the structure other than the emitter is similar to that according to the aforementioned first embodiment, and hence the description is omitted. Portions of the emitter similar to those according to the aforementioned first embodiment are denoted by the same reference numerals, to omit the description.

Figure 9:
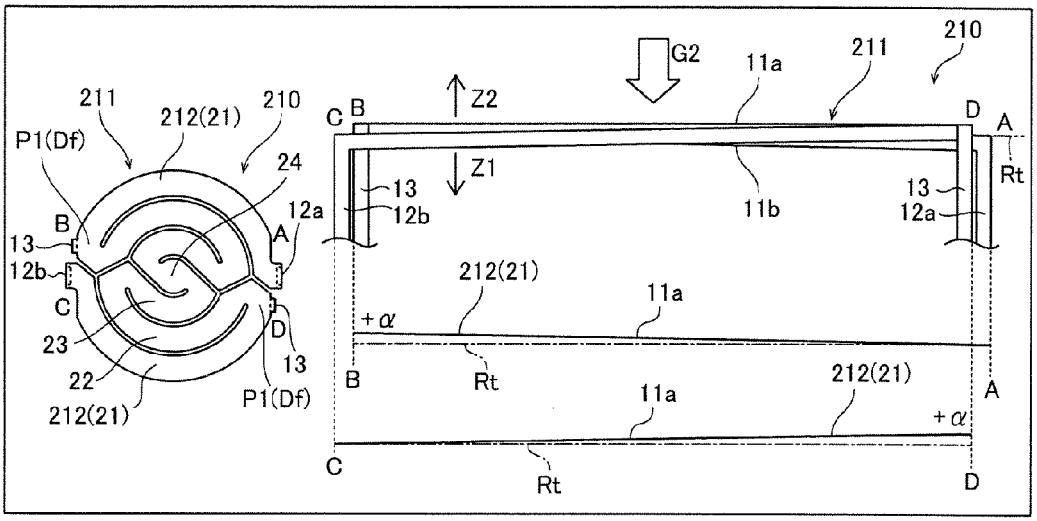
FIG. 9 A schematic view for illustrating an emitter of an X-ray tube device according to a second embodiment of the present invention.

As shown in FIG. 9, the emitter 210 of the X-ray tube device 200 according to the second embodiment is provided such that a direction Z1 (flatness minus direction) from an upper surface 11*a* toward a lower surface 11*b* coincides with a gravity direction (vertically downward) G2 in use. An electron emission portion 211 of the emitter 210 is formed with protrusion portions 212 protruding in the direction (direction Z2) opposite to the deformation direction (gravity direction) of the deformed portions Df in regions containing the deformed portions Df where the degree of variation of the flatness of the electron emission portion 211 resulting from creep deformation associated with the use of the emitter 210 is relatively large.

The protrusion portions 212 are arranged in a current path 20 (first portions 21) of the electron emission portion 211 on the outer peripheral side of the electronic emission portion 211 containing the deformed portions Df. The protrusion portions 212 are formed by inclining the first portions 21 such that the vicinities of connection portions P1 between the first portions 21 and second portions 22 protrude.

Specifically, according to the second embodiment, as to a first portion 21 on the side of one terminal portion 12 (referred to as the terminal portion 12*a*), the first portion 21 from a position A on the side of the terminal portion 12*a* to a position B on the side of a connection portion P1 is inclined in the direction Z2. Thus, the first portion 21 on the side of the terminal portion 12*a* protrudes in the direction Z2 such that the flatness is +α at the position B (protrudes by α with respect to an upper reference surface Rt).

Similarly, as to a first portion 21 on the side of the other terminal portion 12 (hereinafter referred to as the terminal portion 12*b*), the first portion 21 from a position C on the side of the terminal portion 12*b* to a position D on the side of a connection portion P1 is inclined in the direction Z2. Thus, the first portion 21 on the side of the terminal portion 12*b* also protrudes in the direction Z2 such that the flatness is +α at the position D (protrudes by α with respect to the upper reference surface Rt).

The first portions 21 are inclined to form the protrusion portions 212, whereby the second portions 22, third portions 23, and a central portion 24 of the electron emission portion 211 also protrude slightly in the direction Z2, and the upper surface 11*a* of the electron emission portion 211 as a whole is substantially parallel to the upper reference surface Rt.

Due to the aforementioned structure, in the emitter 210, the protrusion portions 212 previously protruding in the direction Z2 such that the flatness is +α can cancel out the variation of flatness in the direction Z1 coinciding with the gravity direction G2. In other words, according to the second embodiment, in the case where the flatness is varied by about −α in the direction Z1 by a sagging phenomenon, the flatness is 0. Thus, sinking in the direction Z1 resulting from the sagging phenomenon is reduced by the amount of protrusion α of the protrusion portions 212, and the lifetime of the emitter 210 until when a desired X-ray focal point diameter fails to be obtained can be increased. The amount of protrusion α of the protrusion portions 212 is preferably larger as long as the desired X-ray focal point diameter can be obtained.

The orientation of the emitter with respect to the gravity direction is varied according to the orientation of the X-ray tube device 200 in use (during exposure) in an apparatus mounted with the X-ray tube device 200. Therefore, as to the use of the X-ray tube device 200, the X-ray tube device 200 including the aforementioned emitter 210 may be employed in the case where the deformation direction (gravity direction G2) coincides with the direction Z1 (flatness minus direction) from the upper surface 11*a* toward the lower surface 11*b*, and the X-ray tube device 200 including the emitter 230 shown in FIG. 10 may be employed in the case where the deformation direction (gravity direction G2) coincides with the direction Z2 (flatness plus direction) from the lower surface 11*b* toward the upper surface 11*a*.

Figure 10:
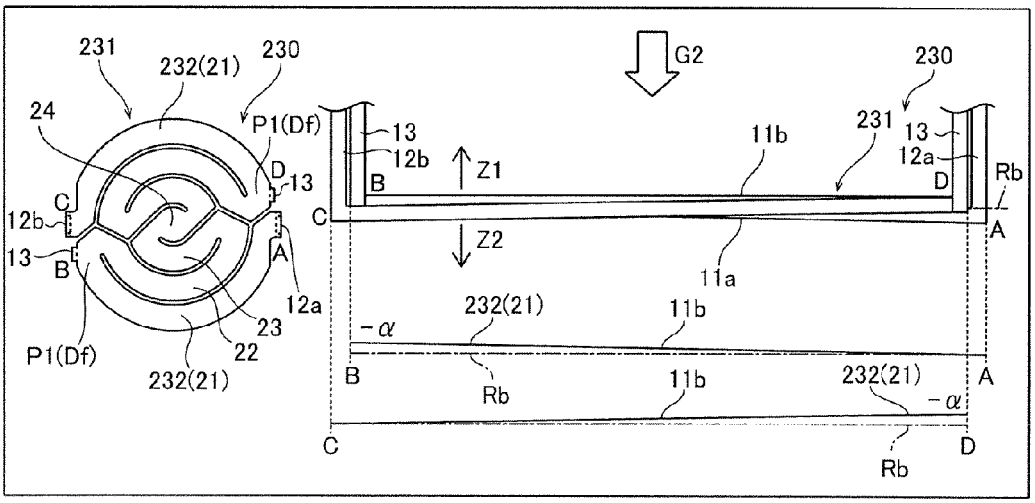
FIG. 10 A schematic view for illustrating another emitter of the X-ray tube device according to the second embodiment of the present invention.

As shown in FIG. 10, the emitter 230 is provided such that the direction Z2 (flatness plus direction) from the lower surface 11*b* toward the upper surface 11*a* coincides with the gravity direction G2 in use, inversely to the emitter 210. An electron emission portion 231 of the emitter 230 is formed with protrusion portions 232 protruding in the direction Z1.

Specifically, as to a first portion 21 on the side of one terminal portion 12*a*, the first portion 21 from a position A on the side of the terminal portion 12*a* to a position B on the side of a connection portion P1 is inclined in the direction Z1 and protrudes in the direction Z1 such that the flatness is −α (protrudes by α with respect to a lower reference surface Rb). Similarly, as to a first portion 21 on the side of the other terminal portion 12*b*, the first portion 21 from a position C on the side of the terminal portion 12*b* to a position D on the side of a connection portion P1 is inclined in the direction Z1 and protrudes in the direction Z1 such that the flatness is −α. Thus, the protrusion portions 232 of the emitter 230 are formed by inclining the first portions 21 in the direction Z1 such that the vicinities of the connection portions P1 of the electron emission portion 231 protrude.

According to the second embodiment, as hereinabove described, the electron emission portion 211 (231) is provided with the protrusion portions 212 (232) protruding in the direction opposite to the deformation direction of the deformed portions Df in the regions containing the deformed portions Df. Thus, the protrusion portions 212 (232) protruding in the direction opposite to the deformation direction can cancel out the variation of flatness even when the creep deformation is generated in the electron emission portion 211 (231). In other words, in the emitter 210 shown in FIG. 9, the protrusion portions 212 previously protruding in the opposite direction Z2 can cancel out the variation of flatness in the direction Z1 coinciding with the gravity direction G2. In the emitter 230 shown in FIG. 10, the protrusion portions 232 previously protruding in the opposite direction Z1 can cancel out the variation of flatness in the direction Z2 coinciding with the gravity direction G2. Thus, while supporting portions 13 suppress deformation, the protrusion portions (212) 232 can cancel out additional deformation even when the deformation is further generated, and hence sinking of the electron emission portion 211 (231) can be more sufficiently suppressed.

According to the second embodiment, as hereinabove described, the protrusion portions 212 (232) are configured to protrude in the direction opposite to the gravity direction G2 in use. Thus, the protrusion portions 212 (232) can cancel out the creep deformation of the electron emission portion 211 (231) resulting from gravity constantly acting on the emitter 210 (230).

According to the second embodiment, as hereinabove described, the protrusion portions 212 (232) are formed by inclining the first portions 21 such that the vicinities of the connection portions P1 between the first portions 21 and the second portions 22 protrude. Thus, the sinking (sagging phenomenon) of the electron emission portion 211 (231) in the vicinity of the connection portions P1 whose flatness is the most easily varied can be reliably and more effectively canceled out.

The remaining effects of the second embodiment are similar to those of the aforementioned first embodiment.

Modification of Second Embodiment

In the aforementioned second embodiment, the protrusion portions 212 (232) are configured to protrude in the direction opposite to the gravity direction G2 in use, but in a modification of the second embodiment, protrusion portions are configured to protrude in a direction different from a gravity direction G2.

Sinking (sagging phenomenon) of an electron emission portion resulting from creep deformation associated with use is generated by a high temperature at the time of applying an electric current to an emitter to heat the same and external force (gravity, inertial force related to centrifugal force, or the like), as described above. Therefore, even in the case where the emitter is oriented in a transverse direction orthogonal to the gravity direction, for example, the flatness of the electron emission portion may be varied by centrifugal force acting on the emitter following rotation of an enclosure 3 or the flatness of the electron emission portion may be varied by inertial force when an entire X-ray tube device is moved by a movement mechanism.

Figure 11:
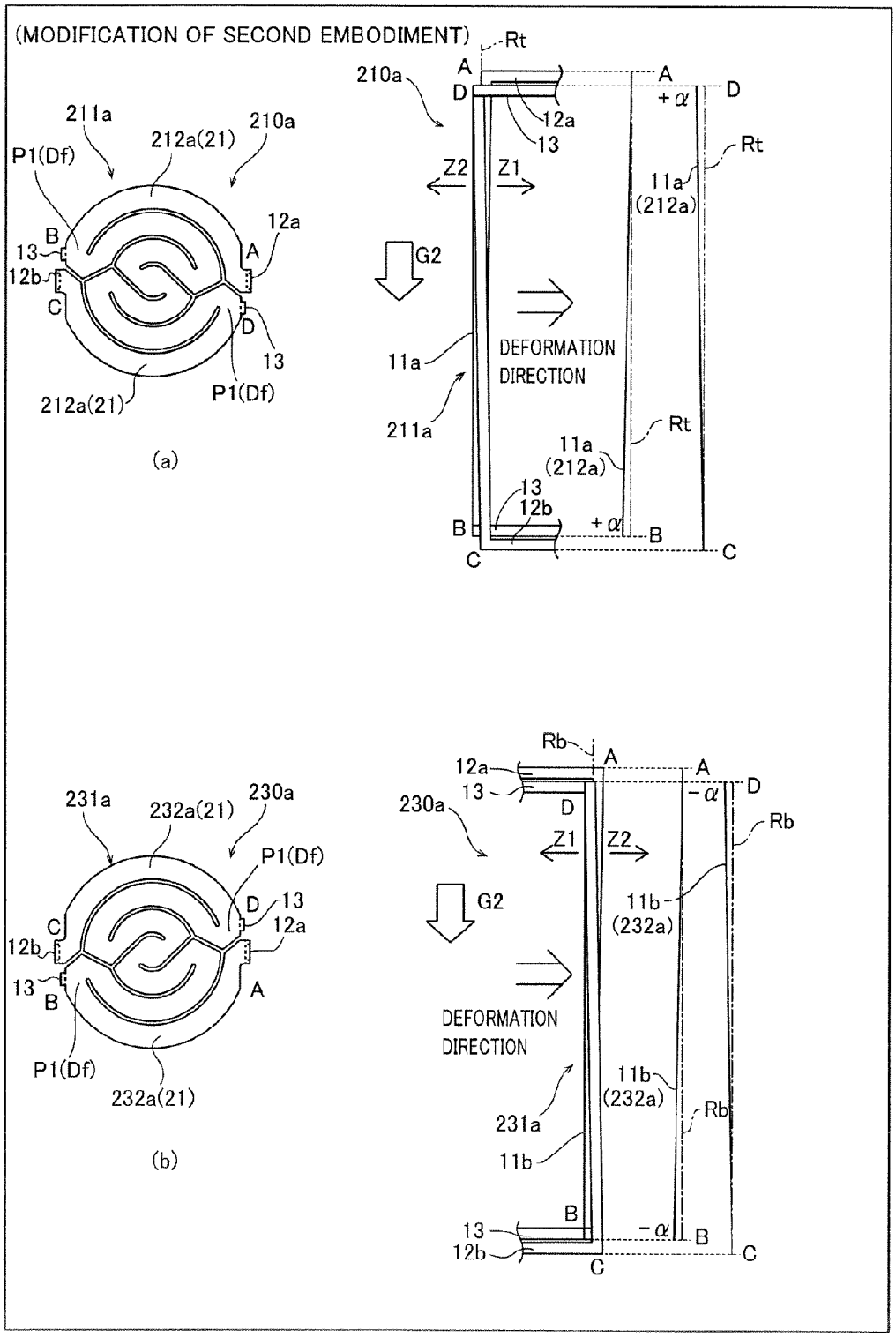
FIG. 11 A schematic view for illustrating an emitter according to a modification of the second embodiment of the present invention.

Thus, according to the modification of the second embodiment, protrusion portions 212*a* (232*a*) are provided in an electron emission portion 211*a* (231*a*) to protrude in a direction opposite to a deformation direction based on the sagging phenomenon even in the case where the gravity direction G2 and the deformation direction are different from each other, as in an emitter 210*a* shown in view (a) of FIG. 11 or an emitter 230*a* shown in view (b) of FIG. 11.

In the emitter 210*a* shown in view (a) of FIG. 10, the protrusion portions 212*a* are formed to protrude in a direction Z2 (flatness plus direction) opposite to the deformation direction in the case where the deformation direction of deformed portions Df is a direction Z1 (flatness minus direction) from an upper surface 11*a* toward a lower surface 11*b*.

In the emitter 230*a* shown in view (b) of FIG. 10, the protrusion portions 232*a* are formed to protrude in the direction Z1 (flatness minus direction) opposite to the deformation direction in the case where the deformation direction of deformed portions Df is the direction Z2 (flatness plus direction) from the lower surface 11*b* toward the upper surface 11*a*.

Even in the case where the orientation (vertical direction) of the emitter 210*a* (230*a*) is different from the gravity direction G2, as in this modification of the second embodiment, the protrusion portions 212*a* (232*a*) protruding in the direction opposite to the creep-deformation direction are provided in the electron emission portion 211*a* (231*a*), whereby sinking (sagging phenomenon) of the electron emission portion 211*a* (231*a*) can be canceled out.

Third Embodiment

An emitter 310 of an X-ray tube device 300 according to a third embodiment of the present invention is now described with reference to FIGS. 1, 12, and 13. In the third embodiment, an example of increasing the path width of a current path including deformed portions of an electron emission portion in addition to the structure of the aforementioned first embodiment in which the supporting portions 13 are provided in the electron emission portion 11 is described. According to the third embodiment, the structure other than the emitter is similar to that according to the aforementioned first embodiment, and hence the description is omitted. Portions similar to those according to the aforementioned first embodiment are denoted by the same reference numerals, to omit the description.

Figure 12:
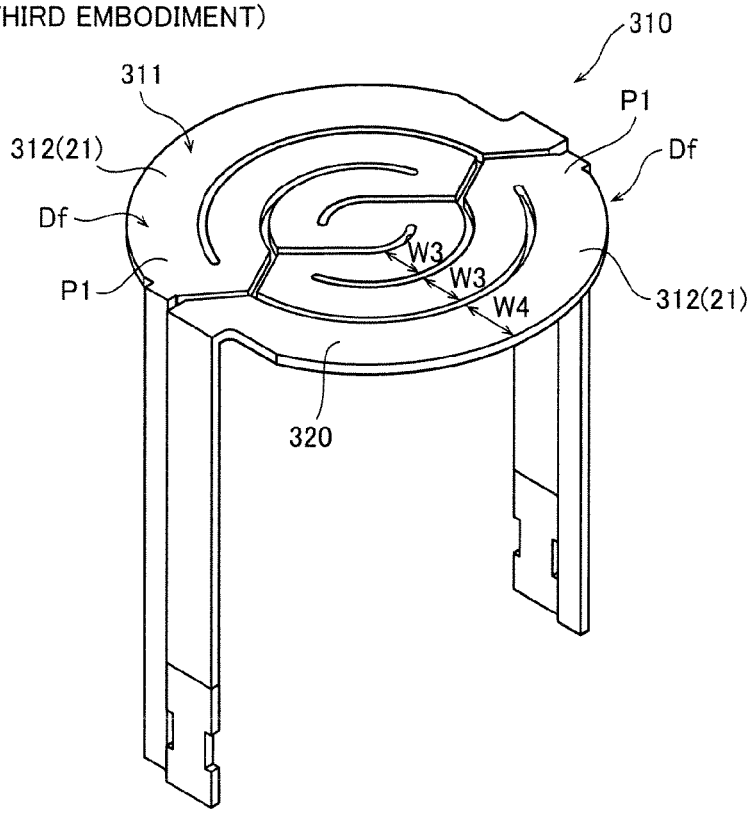
FIG. 12 A perspective view schematically showing an emitter of an X-ray tube device according to a third embodiment of the present invention.
Figure 13:
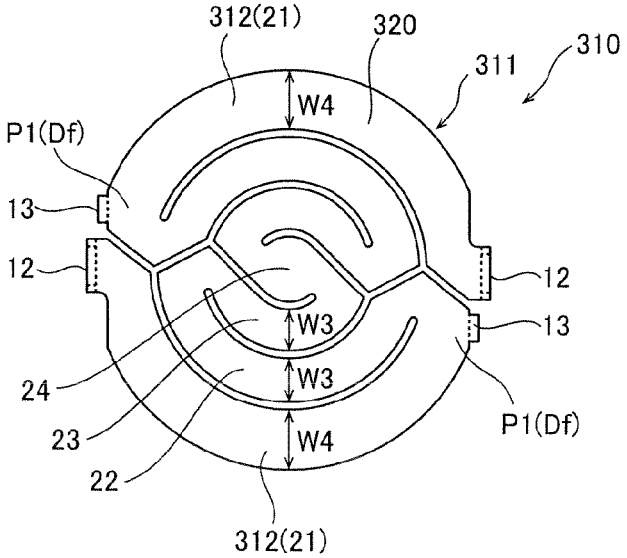
FIG. 13 A top plan view (plan view) showing an electron emission portion of the emitter shown in FIG. 12.

As shown in FIGS. 12 and 13, an electron emission portion 311 of the emitter 310 of the X-ray tube device 300 (see FIG. 1) according to the third embodiment has wide portions 312 whose path widths are larger than those of other portions in a current path 320. Specifically, the current path 320 is formed such that the path widths of portions other than the wide portions 312 are W3 and the path widths of the wide portions 312 are W4 larger than W3.

The wide portions 312 are regions including deformed portions Df and are arranged in the current path 320 of the electron emission portion 311 on the outer peripheral side. More specifically, the wide portions 312 are formed over entire first portions 21 including the vicinities (deformed portions Df) of connection portions P1 between the first portions 21 and second portions 22 of the current path 320. In other words, according to the third embodiment, the entire first portions 21 in the current path 320 are the wide portions 312 each having a path width W4, and the second portions 22 and third portions 23 each have a path width W3. Consequently, in the electron emission portion 311, the mechanical strength of the first portions 21 (wide portions 312) on the outer peripheral side, the path widths of which are relatively large, is larger than that of the second portions 22 and the third portions 23 on the inner peripheral side.

FIGS. 12 and 13 show an example of making the path widths W4 of the first portions 21 (wide portions 312) larger than the path width W1 (see FIG. 3) of the emitter 10 according to the aforementioned first embodiment and making the path widths W3 of the second portions 22 and the third portions 23 other than the wide portions 312 equal to the path width W1. According to the third embodiment, the path widths of the wide portions 312 are only required to be relatively larger than the path widths of other portions. Therefore, the path widths of the wide portions 312 may be made relatively larger by making the path widths of the portions (the second portions 22 and the third portions 23) other than the wide portions 312 smaller than W1.

According to the third embodiment, as hereinabove described, the wide portions 312 whose path widths are larger than those of other portions of the current path 320 are provided in the electron emission portion 311. Furthermore, the wide portions 312 are arranged in the regions including the deformed portions Df where the degree of variation of the flatness of the electron emission portion 311 resulting from creep deformation associated with the use of the emitter 310 is relatively large. Thus, the mechanical strength of the current path 320 (wide portions 312) in the region including the deformed portions Df can be relatively improved as compared with that of other portions. Thus, while supporting portions 13 suppress deformation, the wide portions 312 can further suppress deformation, and hence sinking of the electron emission portion 311 can be more sufficiently suppressed.

According to the third embodiment, as hereinabove described, the wide portions 312 are formed in the first portions 21 including the vicinities of the connection portions P1 (deformed portions Df) between the first portions 21 and the second portions 22, on the outer peripheral side of the electron emission portion 311. Thus, the sinking (sagging phenomenon) of the electron emission portion 311 in the vicinity of the connection portions P1 (deformed portions Df) whose flatness is the most easily varied can be reliably and more effectively suppressed.

Fourth Embodiment

An emitter 410 (430) of an X-ray tube device 400 according to a fourth embodiment of the present invention is now described with reference to FIGS. 1, 14, and 15. In the aforementioned second embodiment, the example of providing both the supporting portions 13 and the protrusion portions 212 (232) in the electron emission portion 11 has been shown, but in this fourth embodiment, an example of providing only protrusion portions in an electron emission portion is described. According to the fourth embodiment, the structure other than the emitter is similar to that according to the aforementioned second embodiment, and hence the description is omitted. Portions similar to those according to the aforementioned first embodiment are denoted by the same reference numerals, to omit the description.

Figure 14:
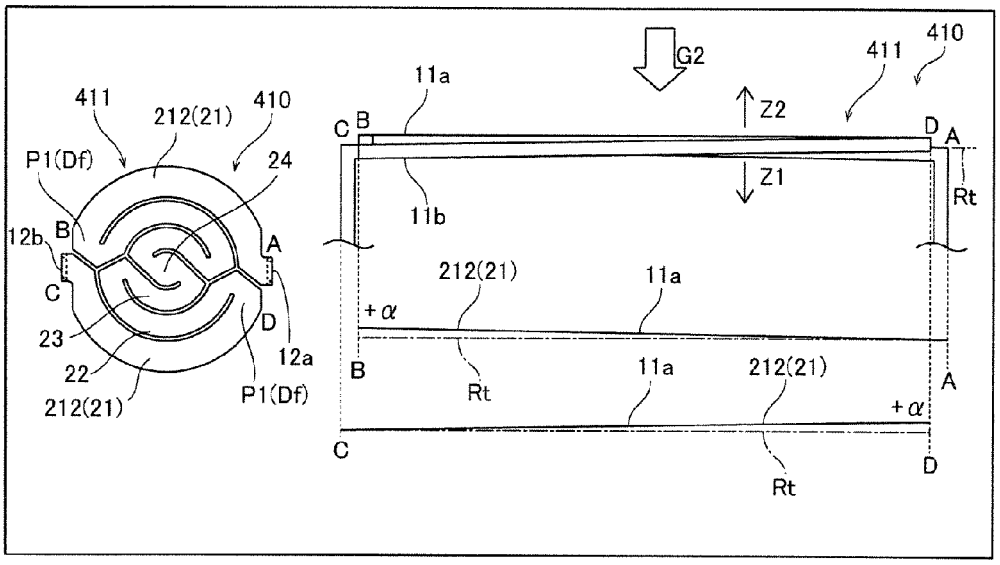
FIG. 14 A schematic view for illustrating an emitter of an X-ray tube device according to a fourth embodiment of the present invention.
Figure 15:
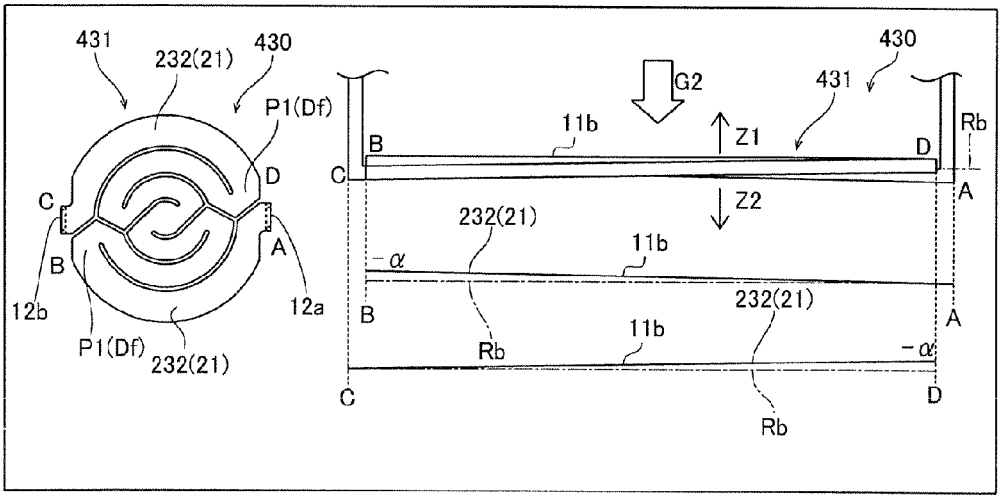
FIG. 15 A schematic view for illustrating another emitter of the X-ray tube device according to the fourth embodiment of the present invention.

As shown in FIGS. 14 and 15, in the emitter 410 (430) of the X-ray tube device 400 (see FIG. 1) according to the fourth embodiment, no supporting portion 13 is provided, but only protrusion portions 212 (232) are formed, unlike in the emitter 210 (230) (see FIGS. 9 and 10) according to the aforementioned second embodiment. The structure of the protrusion portions 212 (232) is similar to that according to the aforementioned second embodiment.

The emitter 410 shown in FIG. 14 is an example in which the deformation direction of deformed portions Df in an electron emission portion 411 is a direction Z1 (flatness minus direction) and coincides with a gravity direction G2 in use.

The emitter 430 shown in FIG. 15 is an example in which the deformation direction of deformed portions Df in an electron emission portion 431 is a direction Z2 (flatness plus direction) and coincides with the gravity direction G2 in use.

Similarly to the aforementioned second embodiment, also according to the fourth embodiment, as to the use of the X-ray tube device 400, the X-ray tube device 400 including the emitter 410 shown in FIG. 14 may be employed in the case where the direction Z1 (flatness minus direction) coincides with the deformation direction (gravity direction), and the X-ray tube device 400 including the emitter 430 shown in FIG. 15 may be employed in the case where the direction Z2 (flatness plus direction) coincides with the deformation direction (gravity direction).

According to the fourth embodiment, as hereinabove described, the protrusion portions 212 (232) protruding in a direction opposite to the deformation direction of the deformed portions Df are previously provided in regions including the deformed portions Df of the electron emission portion 411 (431), whereby the protrusion portions 212 (232) protruding in the direction opposite to the deformation direction can cancel out the variation of flatness even when creep deformation is generated in the electron emission portion 411 (431). Thus, the variation of flatness in the regions including the deformed portions Df can be canceled out, and hence sinking of the electron emission portion 411 (431) resulting from the creep deformation associated with use can be sufficiently suppressed.

Thus, according to the fourth embodiment, no supporting portion 13 is provided, but only the protrusion portions 212 (232) are provided, whereby the sinking of the electron emission portion 411 (431) can be suppressed.

Also in the case where the gravity direction G2 does not coincide with the deformation direction of the deformed portions Df, as in the modification of the second embodiment shown in FIG. 11, protrusion portions 212*a* (232*a*) protruding in the direction opposite to the deformation direction of the deformed portions Df are formed, whereby the sinking of the electron emission portion 411 (431) can be suppressed.

Fifth Embodiment

An emitter 510 of an X-ray tube device 500 according to a fifth embodiment of the present invention is now described with reference to FIGS. 1, 16, and 17. In the aforementioned third embodiment, the example of providing both the supporting portions 13 and the wide portions 312 in the electron emission portion 11 has been shown, but in the fifth embodiment, an example of providing only wide portions in an electron emission portion is described. According to the fifth embodiment, the structure other than the emitter is similar to that according to the aforementioned third embodiment, and hence the description is omitted. Portions similar to those according to the aforementioned first embodiment are denoted by the same reference numerals, to omit the description.

Figure 16:
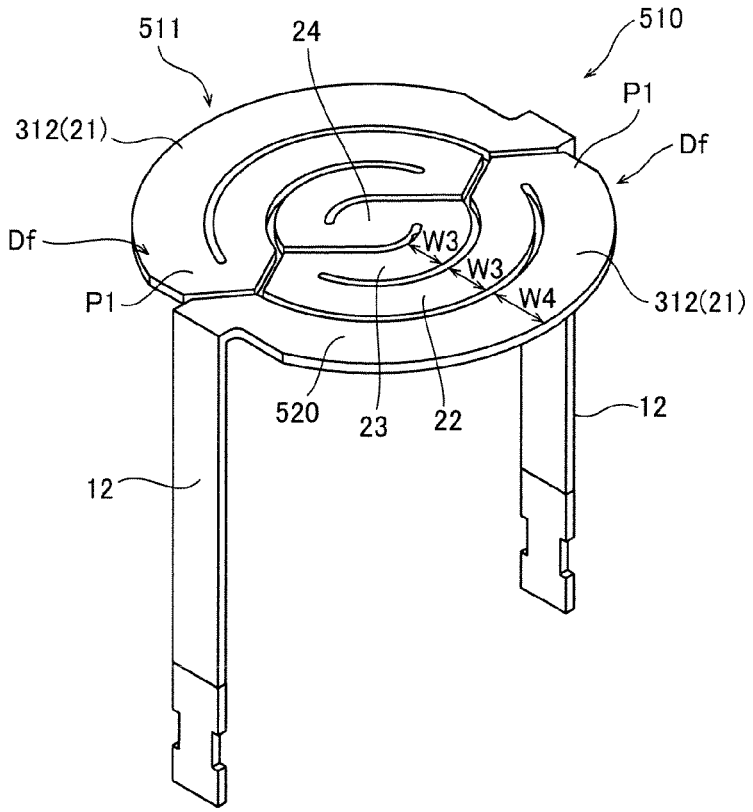
FIG. 16 A perspective view schematically showing an emitter of an X-ray tube device according to a fifth embodiment of the present invention.
Figure 17:
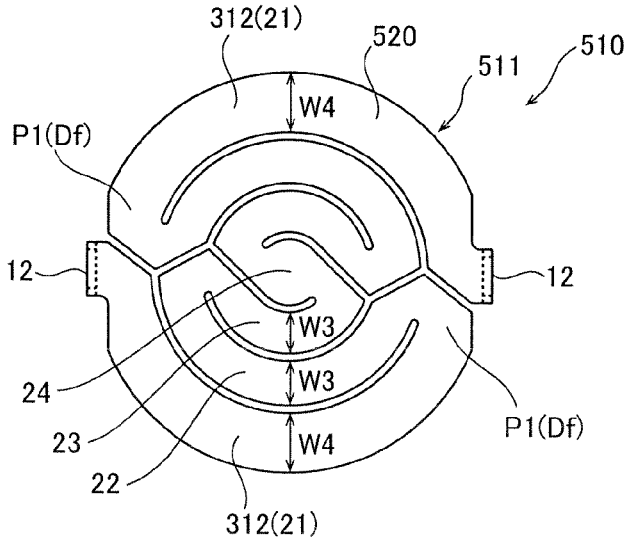
FIG. 17 A top plan view (plan view) showing an electron emission portion of the emitter shown in FIG. 16.

As shown in FIGS. 16 and 17, in an electron emission portion 511 of the emitter 510 of the X-ray tube device 500 (see FIG. 1) according to the fifth embodiment, no supporting portion 13 is provided, but only wide portions 312 are formed in a current path 520, unlike in the emitter 310 according to the aforementioned third embodiment. The structure of the wide portions 312 is similar to that according to the aforementioned third embodiment.

Also in this fifth embodiment, the path widths of the wide portions 312 may be made relatively larger by making the path widths of portions (second portions 22 and third portions 23) other than the wide portions 312 smaller.

According to the fifth embodiment, as hereinabove described, the wide portions 312 whose path widths are larger than those of other portions of the current path 520 are provided in the electron emission portion 511. Furthermore, the wide portions 312 are arranged in regions including deformed portions Df. Thus, the mechanical strength of the current path 520 (wide portions 312) in the regions including the deformed portions Df can be relatively improved. Consequently, generation of creep deformation in the regions (wide portions 312) including the deformed portions Df can be suppressed, and hence sinking of the electron emission portion 511 resulting from the creep deformation associated with the use of the emitter 510 can be suppressed.

Thus, according to the fifth embodiment, no supporting portion 13 is provided, but only the wide portions 312 are provided, whereby the sinking of the electron emission portion 511 can be sufficiently suppressed.

Sixth Embodiment

A method for using an X-ray tube device according to a sixth embodiment of the present invention is now described with reference to FIGS. 1, 2, 18, and 19. In this sixth embodiment, an example of using any of the X-ray tube devices according to the aforementioned first to fifth embodiments (or the first and second modifications), arranging an emitter in a direction opposite to that in the use of the X-ray tube device (during exposure), and applying an electric current to the emitter to heat the same is described. In the sixth embodiment, an example of using the X-ray tube device 100 (see FIG. 1) according to the aforementioned first embodiment is shown as an example of the structures shown in the aforementioned first to fifth embodiments (or the first and second modifications).

An example of an apparatus configuration for using the X-ray tube device 100 is now described. The X-ray tube device 100 is a medical X-ray tube, for example, and is mounted on an X-ray imaging apparatus such as an X-ray apparatus or a tomographic X-ray apparatus.

Figure 18:
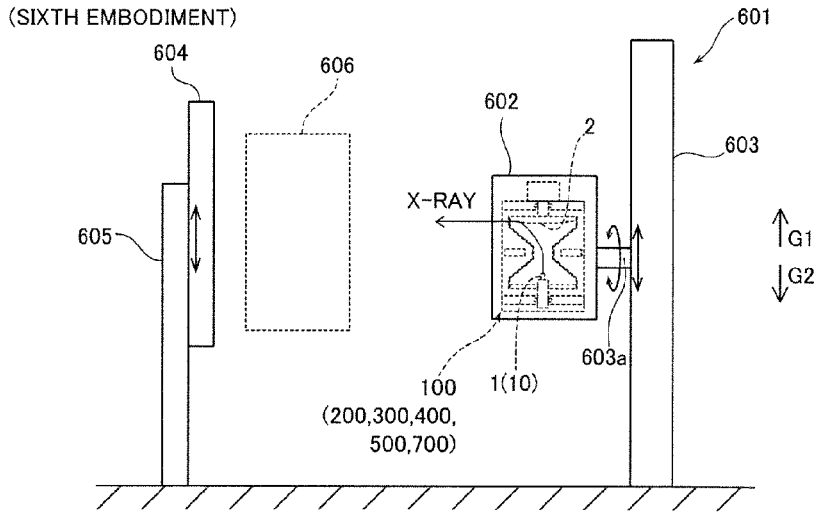
FIG. 18 A schematic view showing an apparatus configuration for illustrating a method for using an X-ray tube device according to a sixth embodiment of the present invention.

As shown in FIG. 18, an X-ray imaging apparatus 601 includes an irradiating portion 602 incorporating the X-ray tube device 100 and a supporting mechanism 603 movably supporting the irradiating portion 602. The irradiating portion 602 is supported to be rotatable about a shaft by a rotation shaft 603*a* of the supporting mechanism 603 and is configured to be movable vertically and horizontally together with the rotation shaft 603*a*. An imaging portion 604 including an X-ray detector is arranged to be opposed to the irradiating portion 602 in a direction of X-ray irradiation by the irradiating portion 602 (X-ray tube device 100). This imaging portion 604 is also supported by a supporting mechanism 605 to be capable of moving up and down.

In the use of the X-ray imaging apparatus 601, an X-ray is irradiated from the X-ray tube device 100 in a state where a subject (patient) is arranged at a prescribed imaging position 606 between the irradiating portion 602 and the imaging portion 604. The imaging portion 604 detects the X-ray irradiated from the irradiating portion 602 (X-ray tube device 100) to carry out X-ray imaging.

In the use (during exposure), the emitter 10 emits an electron in a state where the same is oriented in a direction G1 (vertically upward) along a gravity direction (vertically downward) G2 to be opposed to a target 2 in order to generate an X-ray. In other words, as shown in view (a) of FIG. 19, the upper surface 11*a* of the electron emission portion 11 is the electron emission surface, and hence the emitter 10 is applied with an electric current to be heated in a state where the direction Z2 of the emitter 10 from the lower surface 11*b* toward the upper surface 11*a* is oriented in the direction G1, whereby the X-ray is generated.

Consequently, when the creep deformation (sagging phenomenon) associated with use (exposure) is generated, the electron emission portion 11 is deformed in a direction Z1 coinciding with the gravity direction G2, and the flatness is varied in a minus direction.

According to the sixth embodiment, in the non-use of the X-ray tube device 100 (when no exposure is carried out), the irradiation portion 602 (X-ray tube device 100) is rotated about the rotation shaft 603*a*, and the emitter 10 is applied with an electric current to be heated in an upside-down state.

Figure 19:
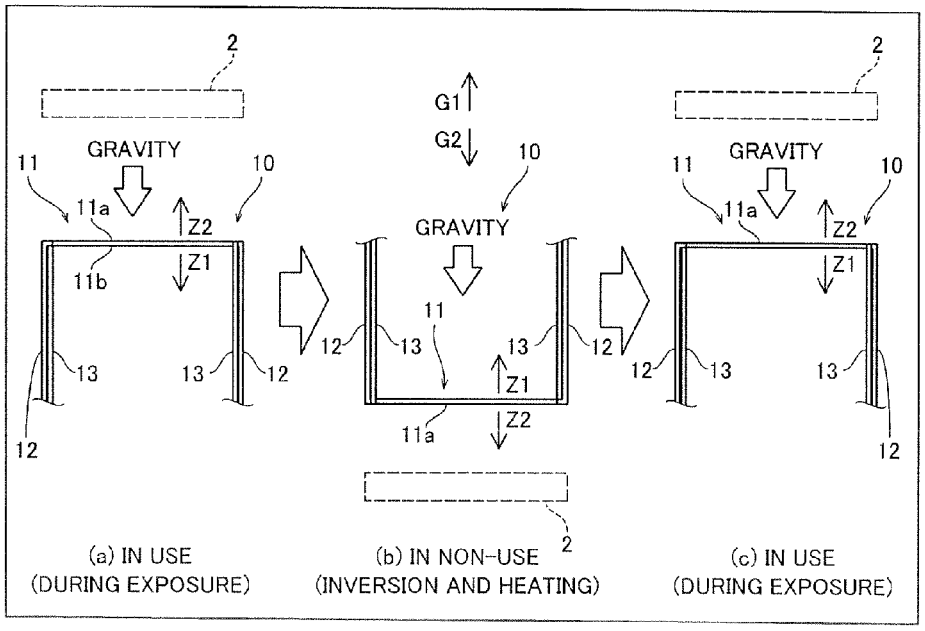
FIG. 19 A schematic view for illustrating the method for using the X-ray tube device according to the sixth embodiment of the present invention.

Specifically, as shown in view (b) of FIG. 19, the irradiation portion 602 (X-ray tube device 100) is rotated to invert the emitter 10 such that the direction Z2 of the emitter 10 is oriented in the direction G2 opposite to that in use. Then, the emitter 10 is applied with an electric current to be heated in a state where the emitter 10 (electron emission portion 11) is opposed to the target 2 such that the direction Z2 of the emitter 10 is oriented in the direction G2 opposite to the direction G1.

Consequently, when the creep deformation (sagging phenomenon) associated with application of an electric current and heating is generated, the electron emission portion 11 is deformed in the direction Z2 coinciding with the gravity direction G2, and the flatness is varied in a plus direction. Therefore, due to the inversion and heating in non-use shown in view (b) of FIG. 19, the variation of flatness in the minus direction in use shown in view (a) of FIG. 19 is canceled out by the variation of flatness in the plus direction.

Thereafter, in subsequent use (during subsequent exposure), the emitter 10 is returned to a state where the same is oriented in the direction G1 to be opposed to the target 2 again, as shown in view (c) of FIG. 19, and an X-ray is generated. The above is repeated, whereby the variation of the flatness of the electron emission portion 11 generated in the use of the X-ray tube device 100 can be canceled out in non-use.

According to the sixth embodiment, the inversion and heating in non-use shown in view (b) of FIG. 19 is carried out under the same conditions (heating temperature (current value)) as those of application of an electric current to the emitter 10 to heat the same in use for a time substantially equal to the total time to apply an electric current to the emitter 10 to heat the same in use. During this inversion and heating in non-use, it is only required to apply an electric current to the emitter 10 and heat the same, and hence it is not required to generate an X-ray. The inversion and heating in non-use may be carried out during night-time hours when the X-ray imaging apparatus 601 is not used, on holidays for a facility using the X-ray imaging apparatus 601, or the like, for example.

According to the sixth embodiment, as hereinabove described, the emitter 10 is applied with an electric current to be heated in the state where the same is orientated in the direction G2 along the gravity direction, opposite to the direction G1 in use (during exposure) to be opposed to the target 2. Thus, the variation of the flatness of the electron emission portion 11 in the direction Z1 resulting from the creep deformation generated in normal use (during exposure) can be canceled out by the variation of flatness in the opposite direction (direction Z2) generated by applying an electric current to the emitter 10 and heating the same in the state where the same is oriented in the direction G2. Thus, sinking (sagging phenomenon) of the electron emission portion 11 resulting from the creep deformation associated with the use of the emitter 10 can be effectively suppressed.

According to the sixth embodiment, as hereinabove described, the X-ray tube device 100 including the emitter 10 having the supporting portions 13 (see FIG. 2) provided separately from the terminal portions 12, insulated from the electrodes 1*a*, supporting the electron emission portion 11 is used, whereby the flat plate-like electron emission portion 11 can be supported by the supporting portions 13, and hence the sinking (sagging phenomenon) of the electron emission portion 11 resulting from the creep deformation associated with use can be suppressed.

In this sixth embodiment, the example of using the X-ray tube device 100 according to the aforementioned first embodiment has been shown, but the present invention is not restricted to this. In the sixth embodiment, any of the X-ray tube devices according to the aforementioned second to fifth embodiments (or the modifications of the first and second embodiments) other than the first embodiment may be used. Also in these cases, the sinking (sagging phenomenon) of the electron emission portion 11 can be suppressed similarly.

Seventh Embodiment

A method for using an X-ray tube device according to a seventh embodiment of the present invention is now described with reference to FIGS. 1, 6, and 20. In this seventh embodiment, an example of arranging an emitter in a direction opposite to that in the use of an X-ray tube device (during exposure) and applying an electric current to the emitter to heat the same in the structure of the X-ray tube device other than the X-ray tube devices according to the aforementioned first to fifth embodiments (or the modifications of the first and second embodiments) is described.

An emitter 710 of an X-ray tube device 700 (see FIG. 1) used in the seventh embodiment is provided with no supporting portion 13, unlike the emitter 10 according to the aforementioned first embodiment. The emitter 710 is provided with no protrusion portion 212 (232) shown in the aforementioned second embodiment or wide portion 312 shown in the aforementioned third embodiment and has a structure similar to that of the emitter according to Comparative Example shown in FIG. 6. The remaining structure of the emitter 710 is similar to that according to the aforementioned first embodiment, and hence the description is omitted.

Figure 20:
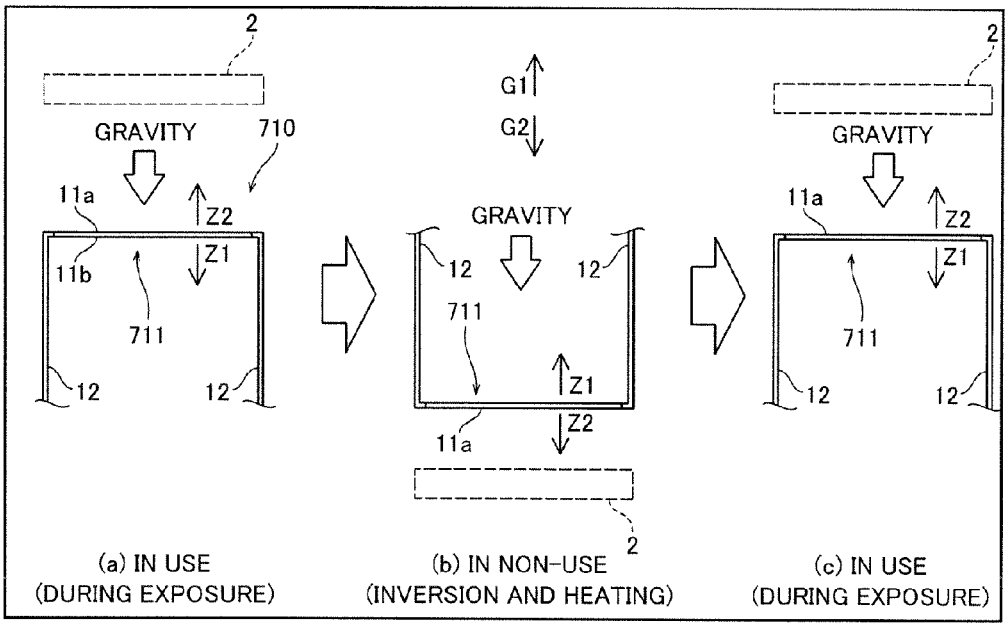
FIG. 20 A schematic view for illustrating a method for using an X-ray tube device according to a seventh embodiment of the present invention.

According to the seventh embodiment, as shown in view (a) to view (c) of FIG. 20, the X-ray tube device 700 having the emitter 710 is employed to generate an X-ray in use (during exposure) in a state where the emitter 710 is oriented in a direction G1 (vertically upward) along a gravity direction and apply an electric current to the emitter 710 to heat the same (invert the emitter 710 to heat the same) in non-use in a state where the emitter 710 is oriented in a direction G2 (a direction of action of gravity, vertically downward) opposite to that in use. The structure of an X-ray imaging apparatus using the X-ray tube device 700, the specific operation of the X-ray tube device 700 in use (during exposure), and the specific operation of the X-ray tube device 700 in non-use (during inversion and heating) are similar to those according to the aforementioned sixth embodiment.

Consequently, the variation of the flatness of an electron emission portion 711 in a minus direction (direction Z1) in use shown in view (a) is canceled out by the variation of the flatness of the electron emission portion 711 in a plus direction (direction Z2) during inversion and heating in non-use shown in view (b) of FIG. 20.

According to the seventh embodiment, as hereinabove described, the emitter 710 is applied with an electric current to be heated in a state where the same is orientated in the direction G2 along the gravity direction, opposite to the direction G1 in use (during exposure) to be opposed to a target 2. Thus, the variation of the flatness of the electron emission portion 711 in the direction Z1 resulting from creep deformation generated in normal use (during exposure to X-ray) can be canceled out by the variation of flatness in the opposite direction (direction Z1) generated by applying an electric current to the emitter 710 and heating the same in the state where the same is oriented in the direction G2. Thus, sinking (sagging phenomenon) of the electron emission portion 711 resulting from the creep deformation associated with the use of the emitter 710 can be sufficiently suppressed.

Thus, according to the seventh embodiment, no supporting portion 13 is provided, but the emitter 710 is only inverted and heated, whereby the sinking of the electron emission portion 711 can be sufficiently suppressed.

The embodiments and Example disclosed this time must be considered as illustrative in all points and not restrictive. The range of the present invention is shown not by the above description of the embodiments and Example but by the scope of claims for patent, and all modifications within the meaning and range equivalent to the scope of claims for patent are further included.

For example, while the example of applying the present invention to the enclosure rotation type X-ray tube device has been shown in each of the aforementioned first to seventh embodiments, the present invention is not restricted to this. The present invention may be applied to an X-ray tube device other than the enclosure rotation type X-ray tube device, such as an anode rotation type X-ray tube device in which only an enclosure is fixed or an anode fixed X-ray tube device, for example.

While the example of providing the circular electron emission portion in the plan view has been shown in each of the aforementioned first to seventh embodiments, the present invention is not restricted to this. According to the present invention, the plan view of the electron emission portion may be rectangular or polygonal so far as the electron emission portion is in a flat plate shape. When the electron emission portion is employed in the enclosure rotation type X-ray tube device in which the emitter (electron emission portion) rotates, the plan view of the electron emission portion is preferably circular or roughly circularly polygonal in view of stability of rotation.

While the example of forming the flat plate-like electron emission portion by the current path having the first to third portions and the central portion has been shown in each of the aforementioned first to seventh embodiments, the present invention is not restricted to this. According to the present invention, the flat plate-like electron emission portion may be formed by a current path in a shape different from the shape shown in each of the aforementioned embodiments. In this case, the positions of the deformed portions where the variation of flatness is large are varied according to the shape of the current path constituting the electron emission portion, and hence the arrangement of the supporting portions may be determined according to the shape of the electron emission portion (current path).

While the example of forming the supporting portions to extend to the same side as that of the terminal portions of the emitter has been shown in each of the aforementioned first to third and sixth embodiments, the present invention is not restricted to this. According to the present invention, the supporting portions may be formed to extend to a side different from that of the terminal portions and may be provided to extend to the lateral side (in a direction parallel to the flat plate-like electron emission portion) of the emitter, for example.

While the example of providing the pair of (two) supporting portions in the emitter has been shown in each of the aforementioned first to third and sixth embodiments, the present invention is not restricted to this. One or three or more supporting portions may be provided. In the case where there are many supporting portions, however, heat of the electron emission portion during application of an electric current and heating may be released to the supporting portions, and the temperature distribution of the electron emission portion may be varied. Thus, so far as the number of supporting portions is sufficient to support the electron emission portion, it is preferable to provide as small a number of supporting portions as possible.

While the example of mounting the X-ray tube device on the X-ray imaging apparatus 601 such as the X-ray apparatus has been shown as an example of use in each of the aforementioned sixth and seventh embodiments, the present invention is not restricted to this. The present invention may be applied to an X-ray tube device used in an industrial apparatus such as an X-ray inspection apparatus (non-destructive inspection apparatus), for example, in addition to the medical X-ray imaging apparatus.

REFERENCE NUMERALS

1: electron source (cathode)
1*a*: electrode

2: target (anode)
3: enclosure
10, 110, 210, 210*a*, 230, 230*a*, 310, 410, 430, 510, 710: emitter
11, 211, 211*a*, 231, 231*a*, 311, 411, 431, 511, 711: electron emission portion
12 (12*a*, 12*b*): terminal portion
13, 113: supporting portion
20, 320, 520: current path
21: first portion
22: second portion
212, 212*a*, 232, 232*a*: protrusion portion
312: wide portion
Df: deformed portion
P1: connection portion
100, 200, 300, 400, 500, 700: X-ray tube device

The invention claimed is:

1. An X-ray tube device comprising:
an anode; and
a cathode including an emitter emitting an electron to the anode, wherein
the emitter includes:
an electron emission portion formed in a plate shape by a current path,
a pair of terminal portions extending from the electron emission portion, connected to an electrode, and
a supporting portion provided separately from the terminal portions, insulated from the electrode, supporting the electron emission portion,
the current path includes at least a first portion on the outer peripheral side extending from one of the terminal portions toward the other of the terminal portions and a second portion extending from the other of the terminal portions toward the one of the terminal portions on an inner peripheral side with respect to the first portion continuously from the first portion, and
the supporting portion is formed at an edge portion of an outermost current path of the electron emission portion in order to support a connection portion between the first portion and the second portion.

2. The X-ray tube device according to claim 1, wherein
the supporting portion is formed to extend to the same side as that of the terminal portions in a direction intersecting with the electron emission portion, and one end thereof is fixed while the other end thereof is coupled to the electron emission portion or is arranged at a position in contact with the electron emission portion.

3. The X-ray tube device according to claim 1, further comprising a tubular enclosure housing the emitter and a target as the anode, rotating about a central axis, wherein
a pair of the supporting portions are provided at positions opposed to each other through the central axis.

4. The X-ray tube device according to claim 1, wherein
the electron emission portion has a protrusion portion inclined in relation to a front surface side or a back surface side of the electron emission portion in the vicinity of the connection portion.

5. The X-ray tube device according to claim 1, wherein
the electron emission portion is formed in the plate shape by the current path which is winding and has a wide portion whose path width is larger than those of other portions of the current path,
the wide portion is arranged in a region including a vicinity of the connection portion.

6. An X-ray tube device comprising:
an anode; and
a cathode including an emitter emitting an electron to the anode, wherein
the emitter includes:
an electron emission portion formed in a plate shape by a current path, and
a pair of terminal portions extending from both ends of the electron emission portion, connected to an electrode, and
the electron emission portion has a protrusion portion, which is a part of an electron emission surface of the electron emission portion inclined at an angle in relation to a front surface side or a back surface side of the electron emission portion.

7. The X-ray tube device according to claim 6, wherein
the protrusion portion is inclined to protrude in a direction opposite to a direction of action of gravity in use.

8. The X-ray tube device according to claim 6, wherein
the electron emission portion is formed in the plate shape by a current path which is winding, and
the protrusion portion is arranged in the current path on an outer peripheral side of the electron emission portion.

9. The X-ray tube device according to claim 8, wherein
the current path includes at least a first portion on the outer peripheral side extending from one of the terminal portions toward the other of the terminal portions and a second portion extending from the other of the terminal portions toward the one of the terminal portions on an inner peripheral side with respect to the first portion continuously from the first portion, and
the protrusion portion is formed by inclining the first portion such that a connection portion between the first portion and the second portion protrudes.

10. An X-ray tube device comprising:
an anode; and
a cathode including an emitter emitting an electron to the anode, wherein
the emitter includes:
a circular electron emission portion formed in a plate shape by a current path which is winding, having a wide portion whose path width is larger than those of other portions of the current path, and
a pair of terminal portions extending from both ends of the electron emission portion, connected to an electrode, and
the wide portion is arranged at the outermost arcuate current paths of the circular electron emission portion and has a length in the circumferential direction larger than its path width.

11. The X-ray tube device according to claim 10, wherein
the electron emission portion includes at least a first portion on the outer peripheral side extending from one of the terminal portions toward the other of the terminal portions and a second portion extending from the other of the terminal portions toward the one of the terminal portions on an inner peripheral side with respect to the first portion continuously from the first portion, and
the wide portion is formed in the first portion including a connection portion between the first portion and the second portion.

* * * * *